US008141495B2

(12) United States Patent
Baker et al.

(10) Patent No.: US 8,141,495 B2
(45) **Date of Patent: *Mar. 27, 2012**

(54) AMUSEMENT PARK RIDE WITH VEHICLES PIVOTING ABOUT A COMMON CHASSIS TO PROVIDE RACING AND OTHER EFFECTS

(75) Inventors: Paul E. Baker, Porter Ranch, CA (US); Mark W. Sumner, Saugus, CA (US); Derek Howard, Pasadena, CA (US); David A. Durham, Northridge, CA (US); Christopher J. Rose, Canyon Country, CA (US); David W. Crawford, Long Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/975,611

(22) Filed: Dec. 22, 2010

(65) Prior Publication Data

US 2011/0088584 A1 Apr. 21, 2011

Related U.S. Application Data

(63) Continuation of application No. 12/871,399, filed on Aug. 30, 2010, now Pat. No. 7,921,781, which is a continuation of application No. 12/114,894, filed on May 5, 2008, now Pat. No. 7,806,054.

(51) Int. Cl.
*A63G 31/02* (2006.01)

(52) U.S. Cl. ..... 104/75; 104/60

(58) Field of Classification Search ..... 104/53, 104/56, 57, 60, 74, 75, 76, 80, 81
See application file for complete search history.

(56) References Cited

U.S. PATENT DOCUMENTS

| | | | | |
|---|---|---|---|---|
| 1,549,927 | A | 2/1924 | Sherry | |
| 4,170,943 | A | 10/1979 | Achrekar | |
| 4,446,659 | A | 5/1984 | Quigley | |
| 4,557,080 | A | 12/1985 | Walworth et al. | |
| 5,794,383 | A | 8/1998 | Labinski | |
| 6,170,402 | B1 | 1/2001 | Rude et al. | |
| 6,533,670 | B1 | 3/2003 | Drobnis | |
| 7,610,859 | B1 | 11/2009 | Dietrich | |
| 7,806,054 | B2 * | 10/2010 | Baker et al. | 104/74 |
| 7,921,781 | B2 * | 4/2011 | Baker et al. | 104/75 |
| 2006/0178221 | A1 | 8/2006 | Threlkel | |
| 2007/0265103 | A1 | 11/2007 | Roodenburg et al. | |

(Continued)

FOREIGN PATENT DOCUMENTS

| | | | |
|---|---|---|---|
| EP | 1332779 | A1 | 1/2003 |
| WO | 03082421 | A2 | 10/2003 |

* cited by examiner

*Primary Examiner* — S. Joseph Morano
*Assistant Examiner* — Zachary Kuhfuss
(74) *Attorney, Agent, or Firm* — Marsh Fischmann & Breyfogle LLP; Kent A. Lembke

(57) ABSTRACT

A ride system is provided that allows selective relative positioning of vehicles in an amusement or theme park ride to simulate racing or other effects. The ride system includes a chassis that is adapted to be supported by and to travel on or along a length of track of a particular ride. A support is attached to the chassis and moves with the chassis during operation of the ride. The ride system includes first and second passenger vehicles that are spaced apart on and supported by the support. A drive assembly is linked to the support and configured to rotate the support about its central axis. During support rotation, the first and second vehicles are moved concurrently relative to the track to alter their relative positioning. The vehicles are each rotated about an axis that extends parallel to the rotation axis, and the rotation may be independent or concurrent.

18 Claims, 14 Drawing Sheets

AMUSEMENT PARK RIDE WITH VEHICLES PIVOTING ABOUT A COMMON CHASSIS TO PROVIDE RACING AND OTHER EFFECTS

RELATED APPLICATIONS

This application is a continuation of U.S. patent application Ser. No. 12/871,399, filed Aug. 30, 2010, issued as U.S. Pat. No. 7,921,781, entitled "Amusement Park Ride with Vehicles Pivoting About a Common Chassis to Provide Racing and Other Effects," which is a continuation of Ser. No. 12/114,893, now U.S. Pat. No. 7,806,054, filed May 5, 2008, which are both hereby incorporated by reference into this application.

BACKGROUND OF THE INVENTION

1. Field of the Invention

The present invention relates, in general, to theme or amusement park rides that simulate racing to guests while also guiding the location, speed, and position of the vehicles on the ride (e.g., the vehicles are not rider controlled such as go karts or the like), and, more particularly, to systems and methods for selectively changing the position of vehicle bodies that are carrying passengers or guests such as by altering a position of two or more vehicles (e.g., in a set of racing vehicles) so as to change the lead and trail vehicles during the course of a ride.

2. Relevant Background

Amusement parks continue to be popular worldwide with hundreds of millions of people visiting the parks each year. Park operators continuously seek new designs for thrill rides because these rides attract large numbers of people to their parks each year. Racing rides are a genre or type of ride that is very popular with guests. In theme and other parks, in addition to high-speed or thrill portions of rides, many rides incorporate a slower portion or segment to their rides to allow them to provide a "show" in which animation, movies, three-dimensional (3D) effects and displays, audio, and other effects are presented as vehicles proceed through such show portions. The show portions of rides are often run or started upon sensing the presence of a vehicle and are typically designed to be most effective when vehicles travel through the show portion at a particular speed.

As a result, it is desirable to provide a racing ride in which the speed, location, and orientation (e.g., face the riders toward a show or other display) of the vehicles can be controlled or guided, which generally rules out rider-controlled racing such as provided by go-karts and similar vehicles where the riders control their speed and location on a course. Guided or controlled vehicles are also desirable in many amusement park settings because they can be operated more safely to ensure that the vehicles do not collide with each other or structure adjacent to the track. Further, guided or controlled vehicles are also useful for providing a high guest throughput for a ride as there is less likelihood that a vehicle will be stopped on a track blocking additional vehicles from proceeding along the ride track or course.

To provide a racing simulation, ride designers have often implemented two sets of side-by-side tracks such as with racing or dueling roller coaster trains. Roller coasters normally have a predefined track loop, and riders load and unload at a platform or station such as at a low elevation when compared to the rest of the track. At the beginning of each ride cycle, a roller coaster car or a train of cars is towed up a relatively steep incline of an initial track section to the highest point on the track. The train of cars is then released from the high point and gains kinetic energy that causes the train to travel around the track circuit or loop without further energy being added and return back to the loading/unloading station. The roller coaster track typically includes various loops, turns, inversions, corkscrews, and other configurations intended to thrill the riders. Racing or dueling roller coasters typically have two side-by-side endless track loops, with the tracks parallel to each other. In this way, a roller coaster train on the first track can race with a roller coaster train on the second track. The racing feature provides added thrills and excitement for the riders as they compete with the nearby passengers of the other train.

Generally, the roller coaster trains and tracks in dueling or racing coasters are made to be nearly as equivalent as possible to provide competitive racing but such design is not adequate to provide consistently exciting or "close" races. For example, if one coaster train or track is consistently faster than the other, the racing trains will increasingly be spaced farther and farther apart as they progress over the track, and the sensation of a tight or close race is lost. As the coasters are propelled only by gravity, the coasters are evenly matched only if the coaster speed related variables such as coaster payload, coaster wheel bearing efficiency, coaster wheel concentricity, wind resistance, coaster tire to track resistance, and the like are comparable. Unfortunately, the operating variables cannot be closely controlled and change over time such that one train may be significantly faster than the other, which reduces the advantages of racing coasters.

To provide more control over the position of the vehicles, some ride designs have included two guided vehicles traveling along two separate tracks but on a guided or controlled chassis upon which each vehicle is mounted. As with the racing roller coasters, these rides have not been widely adopted in part because they are significantly more expensive because they require two sets of tracks, more park real estate or space, and separate on and off-board control systems as well as separate braking systems. From the guest or rider's perspective, the separate track designs may not be convincing and exciting racing experiences because the vehicles do not pass in the same way as race cars or other vehicles pass. In other words, the passing vehicle does not come up behind the vehicle on basically the same path or track (e.g., a race track), pass the previously leading vehicle, and then pull inline but in front of the now-trailing vehicle. Some track-switch and/or cross-over designs have been suggested for implementation with the basic two-track configuration, but such designs still do not closely simulate racing situation passing or behavior because large spacing is used to provide desired safety factors. Such features also require complicated on-board and off-board control to address safety concerns including avoiding collisions between racing vehicles, and such control systems can make such solutions cost prohibitive to implement.

Hence, there remains a need for improved systems and methods for simulating a racing experience in vehicles or cars of theme/amusement park rides. Preferably, such racing amusement park ride systems and methods would be effective for selectively positioning two or more racing vehicles relative to each other to create a racing environment where passing maneuvers are accurately implemented. Further, it may be desirable for the ride systems and methods to be relatively inexpensive to construct and operate and also be adapted for positioning the guests for show portions of the ride (e.g., viewing orientation and vehicle speed near a displayed show or an effect).

SUMMARY OF THE INVENTION

The present invention addresses the above problems by providing racing ride systems in which a vehicle support such as an arm or span beam is provided on a common chassis that rides on a track. Two or more vehicles are mounted upon the support, and the support is rotated (e.g., about its central axis) to change the relative position of the vehicles such as to allow one vehicle to pass the other as the chassis travels on the track. To provide a desired orientation of the vehicles, each of the vehicles may be mounted such that it can be rotated or pivoted on the support. In some cases, a drive assembly is provided in or on the support that responds to driving forces to rotate the support and to also rotate the vehicles. The rotation of the support and vehicles may be performed concurrently and also be similar in magnitude and rate. In this manner, racing vehicles may continue to face forward or in the direction of travel even though the support is rotating, e.g., to better simulate racing cars or the like as the passengers/guests continue to face forward.

More particularly, a ride system is provided that allows selective relative positioning of vehicles in an amusement or theme park ride such as to simulate racing or other desired effects such as to enhance a show portion of a ride. The ride system includes a chassis that is adapted to be supported by and to travel on or along a length of track of a particular ride. A support is attached to the chassis so as to move with the chassis during operation of the ride. The ride system also includes at least first and second passenger vehicles (or bodies) (e.g., some rides have 2, 3, 4, or more vehicles) that are spaced apart on and supported by the support. A drive assembly is linked to the support and configured to rotate the support about a rotation axis such as a central axis of the support. During such support rotation, the first and second vehicles are moved concurrently relative to the track to alter their relative positioning. The first and second vehicles may be positioned on the support such that the rotation axis extends between them and, in some embodiments, the vehicles are each rotated about an axis that extends parallel to the rotation axis such as by having a mounting element rotated by the drive assembly. The vehicle rotation may be independent but in some cases is concurrent or partially concurrent, e.g., with each other and/or with the rotation of the support. In some cases, the vehicles share a common orientation relative to a direction of travel along the track and the drive assembly is configured to maintain this common orientation during the rotation of the vehicles about their individual rotation axes.

In some embodiments, a portion of the drive assembly is housed or positioned within the support, and a drive mechanism on or in the chassis is used to selectively drive the assembly such as in response to signals/power from a ride or vehicle control system. The portion of the drive assembly in the support may include a gear train with a stationary drive gear with the support connected to the drive mechanism to cause the support to rotate. The gear train may also include, a pair of driven gears that rotate about the drive gear with the rotation of the support and that are each attached to one of the vehicles to cause the vehicles to rotate (e.g., concurrently with each other and with the support). The portion of the drive assembly in the support may also take the form of a pulley assembly with a central stationary drive pulley, with the support again linked to the drive mechanism. A pair of driven pulleys may be driven by belts, chains, or the like about the drive pulley with rotation of the support, and each of these driven pulleys may be connected to one of the vehicles to rotate/pivot the vehicles. In other embodiments, the drive assembly may include electric motors or other drive devices, and these may be used to rotate the vehicles concurrently as discussed or independently with their orientation determined by one or more sensing and control systems. With these specific mechanical couplings and drive assemblies understood as examples, those skilled in the art will readily understand that the invention may use numerous other types of couplings and drive assemblies to achieve the desired functionality including all examples provided in the following description and figures and obvious expansions, substitutes, and equivalent structures/components.

According to another aspect of the invention, the support may have a freedom of motion to rotate up to 360 degrees about its rotation axis, and in these cases, the vehicles may be arranged on the support so as to be positionable in an inline vehicle configuration (e.g., with either of the vehicles positioned as a lead vehicle and with such position being exchangeable or selectable such as in response to passenger interaction or the like) and/or in a plurality of side-by-side configurations (e.g., with either of the vehicles on the left side or ride side of the support (and/or track)). In some cases, the support is an elongate arm or span beam, and the vehicles are positioned at opposite ends of the arm. The arm typically will rotate about its central axis, and the vehicles will rotate about axes that are parallel to this central axis.

DETAILED DESCRIPTION OF THE PREFERRED EMBODIMENTS

Briefly, embodiments of the present invention are directed to systems, and associated methods, for amusement park rides that provide racing and/or other effects with vehicles or cars that are selectively positionable. Particularly, the present invention provides ride systems (or track and vehicle systems) that provide two or more vehicles (or vehicle bodies) for carrying passengers on a single or common chassis, which is driven or otherwise caused to ride on a track. In one embodiment, the vehicles are supported at opposite ends of a vehicle support arm, and the support arm is, in turn, centrally supported by a rotatable or pivotable pedestal provided on the common chassis (or extending out from the chassis). A drive assembly is provided in or with the support arm such that when the pedestal is rotated to change the position of the vehicles the supported vehicles are also rotated or pivoted to maintain a desired relative position (e.g., continue to face forward, to a side, backwards, or another direction). Racing effects or simulation may then be provided by controlling the position of the pedestal with some embodiments providing a full 360 degree rotation from a first inline position with a first vehicle in the lead to a side-by-side position to a second inline position with a second vehicle in the lead (and back to the first inline position).

In prior racing simulation rides, the vehicle bodies rode on separate chasses that traveled on separate tracks. In contrast, racing ride systems described herein include two or more vehicles mounted on a common chassis that rides on a single track (or track system). The vehicles are allowed to rotate around a common central axis (e.g., an axis extending through a mounting pedestal provided on the chassis). Collision prevention distances between the vehicles may be maintained through relatively simple, economical mechanical drive and support devices (e.g., a support arm and a drive assembly that causes the support arm to rotate with the pedestal and the vehicles to pivot in a desired manner such as at the same rate as the pedestal and/or as each other to maintain a desired relative orientation). For example, the drive assembly may include a gear train assembly, a belt and pulley assembly, and/or other components to control positioning of the vehicles with arm movement. In some cases, a guest reach or safety envelope may be included in the separation distance maintained between vehicles during pivoting/positioning movements, and this facilitates orienting each vehicle individually while still maintaining proper relative distances. Of course, collision prevention is generally inherent in the system since the spacing between vehicles is maintained and guaranteed at all times.

Figure 1:
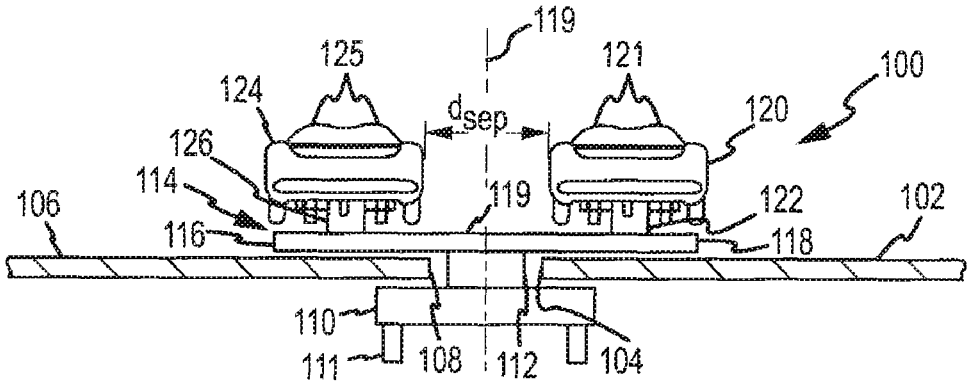
FIG. 1 is a rear, partial sectional view of an amusement park ride or ride system of an embodiment of the invention illustrating use of a common chassis and a pivotable or rotatable pedestal to provide a racing vehicle experience with a single track.
Figure 2:
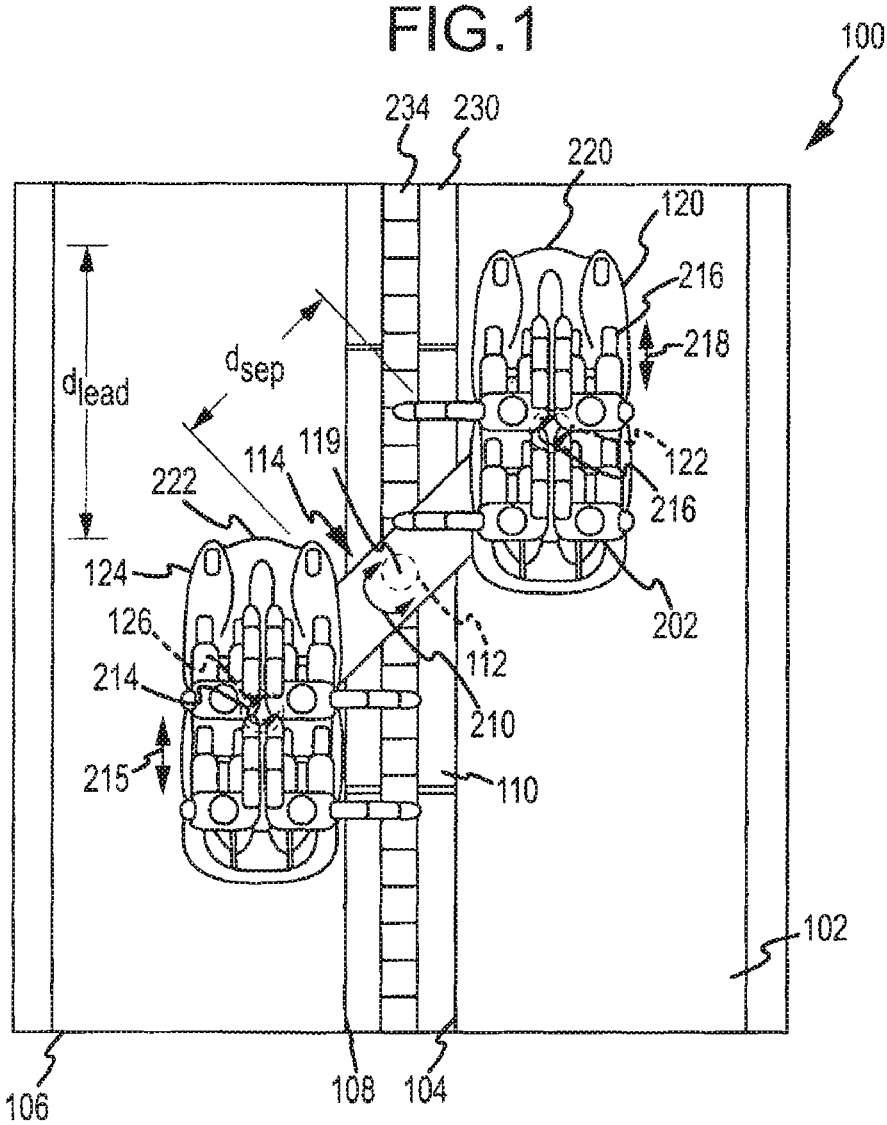
FIG. 2 illustrates a top view of the ride system of FIG. 1 showing operation of the system to simulate racing.

FIGS. 1 and 2 illustrate one useful embodiment for a racing ride assembly 100 of the invention. The assembly 100 is shown to include a single or common chassis 110 that would ride on a single track (not shown) with rollers, wheels, casters, or the like 111. The assembly 100 includes a pedestal 112 that extends upward (in this example) from the chassis 110 through an opening in the track or show platform (e.g., between edges 104, 108 of track platform portions or shelves 102, 106 such as similar to a groove in an electric car racing track). The pedestal 112 moves along a track with the chassis 110, and the pedestal 112 is configured to rotate or pivot as shown with arrow 210 about its central axis or center point 119. In some cases, the entire pedestal 112 may rotate or pivot such as in response to a driver in chassis 110. In other cases, a pivoting or rotating mechanism (not shown) such as an electric motor or the like is provided within the pedestal 112 and linked to a portion of a drive assembly in the adjacent vehicle support arm 114 (such as to a central drive gear, drive pulley, or the like such as shown in FIGS. 4-11).

Significantly, the assembly 100 includes a vehicle support arm 114 that is centrally supported (and, in some cases, driven) by pedestal 112. The support arm 114 is shown to be an elongate member or element extending a length between a first end 116 and a second end 118. However, in other embodiments, the support "arm" may be any of a wide variety of shapes such as a disk, a spoked wheel with a vehicle at each spoke end, a square, a triangle, and the like. In the illustrated example, proximate to each end 116, 118 of the support 114, a vehicle 120, 124 is mounted upon first and second pedestals or mounting elements 122, 126. The vehicle mounting elements 122, 126 may be rigidly attached to the support 114, but, more typically, the mounting elements 122, 126 are attached to a portion of a drive assembly of the support 114 such that they rotate or pivot as shown with arrows 214, 216 in conjunction or concurrent with rotating or pivoting 210 of the arm about the point or axis 119 (e.g., with rotation of the pedestal 112 or a driver in such pedestal 112). For example, the drive assembly may be configured such that the three rotations 210, 214, and 216 are substantially the same (or at least rotations 214 and 216 are substantially equivalent). In this manner, the vehicles 120, 124 remain in the same orientation throughout the rotation of the arm 114 (e.g., with front ends 220, 222 directed forward or along the direction of travel of the chassis 110). Note that rotation 210 will typically be opposite direction of rotations 214 and 216.

In the assembly 100, a two-lane or road race is simulated with the platform halves 102, 106 each representing one of the lanes of a road. The track support 230 and middle rail 234 may also be designed to support this effect such as by painting the middle rail 234 with a road stripe and/or painting the support 230 a color matching the lanes or street surface on platform halves 102, 106. Similarly, the road stripe and lane coloring may be provided on the chassis 110 as shown in FIG. 2. The assembly 100 may be configured such that the vehicles 120, 124 remain in their respective lanes. In such an embodiment, rotation 210 of the support arm 114 about the central axis 119 of pedestal 112 causes each vehicle 120, 124 to move up or back 215, 218 depending upon the direction of the rotation 210. Hence, at the beginning of a ride (or race portion) the vehicles 120, 124 may be positioned such that their front ends 220, 222 are even, i.e., with a lead distance, $d_{lead}$, equal to zero. Then, during the race or travel along the track by the chassis 110, rotation 210 of the pedestal 112 (or a driver in the pedestal 112) pivots the aim 114 about central axis 119 causing the relative movement 215, 218 of the vehicles to increase the lead distance, $d_{lead}$, or to set/define such distance. Throughout the ride operation, the vehicles 120, 124 are also separated a distance, $d_{sep}$, that may be chosen to be large enough to include a safety envelope but in most cases large enough to avoid collision/contact. The control over the position of the support arm 114 (and, hence, attached vehicles 120, 124) may be provided by onboard (or offboard) computer controls. In other cases, cam control may be used such as by an interaction of the pedestal 112 (and/or a driver in the pedestal) with cam drivers provided along the track or on the edges 104, 108 of track platform halves 102, 106. A powered rail on the track may also be used to accomplish vehicle positions by effecting or controlling the positioning 210 of the arm 114.

From the system 100 shown in FIGS. 1 and 2, some of the general features and concepts of the invention may be understood, and it may be appropriate at this point to provide a general discussion of the invention and its embodiments followed by a listing of some of the advantages the invention provides ride designers and operators. Embodiments of the ride system or assembly may be described as providing vehicles or vehicle bodies that carry 1, 2, or more passengers. During operation of the ride assembly, the vehicles may have their positions changed with movement of a supporting arm or plate (e.g., about a central axis of such support structure or the like) and, typically, concurrent rotation or pivoting about an axis passing through a mounting element or pedestal for each vehicle. The support arm may be mounted such that it pivots with a portion of a drive assembly (such as a central drive gear, drive pulley, or the like), and, similarly, the mounting elements or pedestals of the vehicles pivot with a different portion of the drive assembly that is driven by or linked to the portion driving the support arm (such as a driven gear or pulley attached directly to the vehicle body or to an intermediate mounting element/pedestal). Control of the positions of the vehicles by rotating the support arm and, concurrently, the vehicles about rotation axes can be used to provide racing effects including side-by-side excitement, inline portions where one vehicle follows or drafts another vehicle, and exchanging positions (from one side to the other or from lead to follow and so on).

These and other features of the invention described herein provide a racing ride system with numerous advantages over prior multi-track or chassis designs. For example, the racing ride systems eliminate the need for extra track and track switches in portions of the ride where vehicles race and/or exchange position. Also, for two-vehicle solutions where the vehicles exchange position, this invention allows vehicles to be inline in the station or loading/unloading platform without the need for track switches. In racing ride systems, vehicles may be very close (and, in the case of two-vehicle solutions, position inline facing forward or, in some cases, rotated up to 90 degrees to one side or the other) in show areas of the ride, which minimizes the need for repeated show sets after any split as well as avoiding the need for track switches. Since the paired or racing vehicles are closer in show areas, show times in scenes is also increased (e.g., show cycle is longer for equivalent passenger count as compared to separate vehicles separated by block zone logic).

Another advantage of the racing ride systems of embodiments of the invention is that relative vehicle positioning can be achieved/accommodated with very simple mechanical solutions. For example, the use of a rotatable support arm/plate along with a drive assembly in such support that is linked to the vehicles allows the vehicles, in some embodiments, to always stay "pointed" forward or directed in any consistent relative angle throughout the experience (e.g., directed forward in direction of travel to better simulate car racing and the like). This constant vehicle (and contained passenger) orientation allows for more realistic racing when vehicles exchange position when compared with rides that use two separate tracks separated by a guest reach envelope (e.g., more realistic drafting, passing from behind, crossing close in front of each other, and the like).

As is shown in FIGS. 3A-3H and elsewhere, the ride systems can selectively position vehicles in many different relative positions while traversing show scenes and various "race" portions of a track or ride course as opposed to vehicles on separate chasses. This includes but is not limited to: (a) side-by-side for theatrical setting (e.g., for two-vehicle solutions); (b) each vehicle partially offset from centerline for better sightlines or as part of a passing/passed maneuver (see, for example, FIGS. 1 and 2); (c) exchanging positions; and (d) offset vehicle orientations. Since embodiments of the invention allow vehicle groups (paired vehicles, racing sets of vehicles, and like) that can change position (especially, for example, the leader and follower vehicles), past issues with guest desire to be in a particular vehicle is reduced compared to typical ride systems where passenger cars must stay together and/or be inline e.g., roller coasters where passengers often wanted to be in the lead vehicles or received a better show if not in lead or trail cars or the like. Some embodiments of the racing car concept may also be a less expensive solution than trackless ride systems if the ride's show can accommodate its limitations or needs to capitalize on some of its many advantages such as the ability to move faster as a group or exchange positions faster or be pointed in ways relative to each other that trackless vehicles may not be able to reproduce.

Further, embodiments of racing vehicle systems allow for guest (i.e., passenger or rider) influenced interactive competition between vehicles that are in close proximity (e.g., vehicles catch up and pass vehicles based on better guest performance or the like) in a more economical, closer, convincing way than vehicles on separate chasses. Examples which may influence a vehicle passing or maintaining their lead could include, but are not limited to: guests in one of the vehicles "out-pedaling" guests in other vehicle(s); guests in one of the vehicles accumulating better scoring while shooting targets; guests in one of the vehicles more correctly answering trivia questions; guests in one of the vehicles "out-acting" guests in other vehicle(s); and the like. In response to such stimuli or inputs from sensors or the like, a controller or control system may operate the driver or drive mechanism for a drive assembly provided as part of the support arm or separately (e.g., a drive mechanism in the chassis or in the support arm pedestal). This also may occur or happen for pure show programming or dramatic storytelling effect, e.g., be programmed into a controller or control system such as in a show/ride program in memory of a computer that is run by a computer or CPU/processor of a computer or electronic device.

Further, ride systems of the invention may be configured to selectively orientate or position passengers/vehicles in a more economical way. For example, vehicles may be in closer proximity to each other (e.g., have a relatively small separation distance that is equal to or only slightly larger than a guest reach envelope or the like) while being in different orientations relative to each other (e.g., one yawed at 60 degrees while the other is yawed at 30 degrees or the like), which is in part achievable since the guest reach envelope can be maintained with a simple mechanical solution on the common chassis (e.g., use of a support arm and drive assembly as described herein). Control of vehicle position is more readily (and simply and inexpensively) controlled such as with a reliable on-board ride control system (e.g., Simplex as implemented by Disney Enterprises, Inc. in rides in their parks or the like). Control is simplified relative to multiple track and chassis implementations since vehicle-to-vehicle position changes can be performed while maintaining a safe separation distance by a simple mechanical solution. This also allows for higher acceleration and higher speed position changes between vehicles than other race ride designs.

FIGS. 3A-3H illustrate an embodiment of a race ride system 300 similar to system 100 of FIGS. 1 and 2 that is configured for selectively positioning a pair of racing vehicles in a variety of positions including inline positions (i.e., with either vehicle being a leader/trailer). As shown, the system 300 includes a common chassis 310 with wheels, rollers, or the like for contacting a track assembly (not shown). A station, show, or ride platform is provided with spaced apart halves or portions 302 and 306. The system 300 includes a pedestal 312 extending outward from the common chassis 310, and the pedestal 312 is configured to rotate such as with a driver in the chassis 310 or the pedestal 312 includes a drive mechanism (or a transmission device from the chassis 310) that is selectively or controllably driven or caused to rotate about a central axis 319.

A support arm 314 is provided in system 300 and mounted upon the pedestal 312. The arm 314 has a vehicle 324 attached via a mounting element or pedestal 326 near a first end 316 and a vehicle 320 attached via a mounting element or pedestal 322 near a second end 318. When the arm 314 is caused by a mechanism in the pedestal 312 or with a rotatable pedestal 312 to rotate about its central axis 319, the vehicles 320, 324 are repositioned relative to each other and relative to the track (or direction of travel). As will be explained with reference to FIGS. 4-11, a drive assembly is typically provided in the support arm 314 such that the mounting elements 322, 326 are rotated in response to rotation of the arm 314 to provide a desired orientation of the vehicles 320, 324 (such as front ends both forward or toward a show element (e.g., 30 to 90 degrees from the direction of travel or the track)).

Figure 3A:
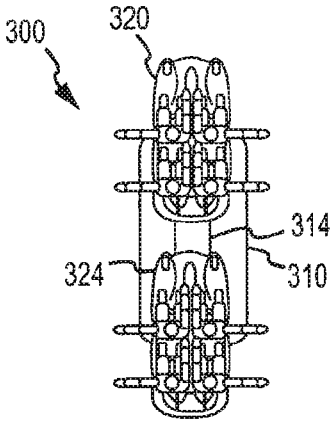
FIGS. 3A-3H illustrate an embodiment similar to that Shown in FIGS. 1 and 2 of a racing ride system showing a common chassis/pivotable pedestal that is configured for selectively positioning a pair of vehicles in a number of positions relative to each other to simulate racing as well as supporting loading/unloading and show portions.
Figure 3B:
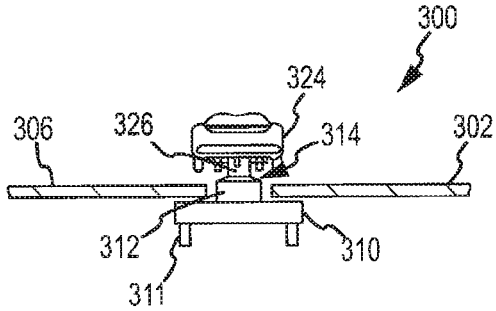

FIGS. 3A and 3B illustrate the system 300 with the support arm 314 in an inline position. The inline position is useful for loading and unloading in a station and also for some common show, scene, or display portions of a ride. Further, the inline position is desirable in racing ride system 300 for simulating portions of a race where a trailing vehicle is drafting a leading vehicle or when one vehicle is winning a race by a large amount. Also, inline positioning better simulates a full pass where the passing vehicle pulls in front of the passed vehicle. Further, use of the inline position is desirable for allowing the two racing vehicles to pass through narrow portions of a ride such a tunnel or the like (e.g., where the arm 314 may be quickly swung into the inline position immediately prior to entering the tunnel or restricted-width portion to add thrill and a feel of danger to a ride 300). In the embodiment shown, the vehicles 320, 324 pivot with the arm 314 such that their front ends are facing forward and their bodies are generally inline with the arm 314 and/or with the track (not shown). In FIGS. 3A and 3B, the vehicle 320 is the lead car and the vehicle 324 is the trailing or drafting car. However, these relative positions may be switched in the loading, unloading, and/or in various locations of the track/course.

Figure 3C:
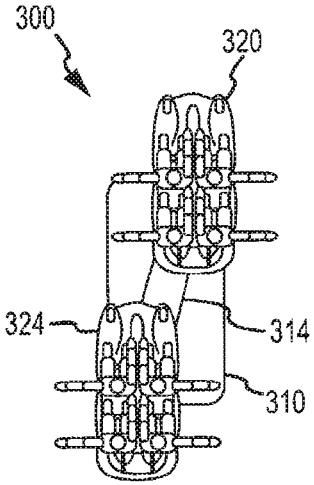
Figure 3D:
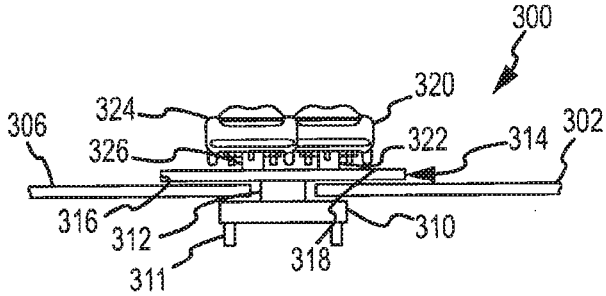

The ride system 300 supports a wide range of positioning, and FIGS. 3C and 3D illustrate a "ready to make move" or non-inline position (e.g., a race permutation or stage of a ride). This is achieved in practice by a controller or control system signaling a driver or drive mechanism (such as one in the chassis 310 or pedestal 312) to rotate the support arm 314 a select amount in the clockwise direction (or in other cases in the counterclockwise direction to pass on the right rather than on the left as shown) about the central axis 319. Again, the move from the inline to the move/pass initiation position may be initiated by a variety of inputs such as interaction of the riders with devices in the vehicles 320, 324 (such as pedals, I/O devices, and the like) or outside the vehicles such as interacting with a show/ride display or such in response to a program (e.g., a scripted race in which passing occurs at particular locations consistently/repeatedly for each ride or in a random/differing manner each consecutive ride). This rotation of the arm 314 causes both vehicles 320, 324 to move from the inline position and causes the drafting or trailing vehicle 324 to "gain" upon the lead vehicle 320 (e.g., to have the distance between a point on each vehicle such as the front of the cars to be reduced in magnitude). Also, in this embodiment, the vehicles 320, 324 are being rotated an equal amount relative to each other (such as by rotation or pivoting of the mounting elements 322, 326 by a drive assembly (not shown in FIGS. 3A-3H)) such that they continue to "drive" forward along the track.

Figure 3E:
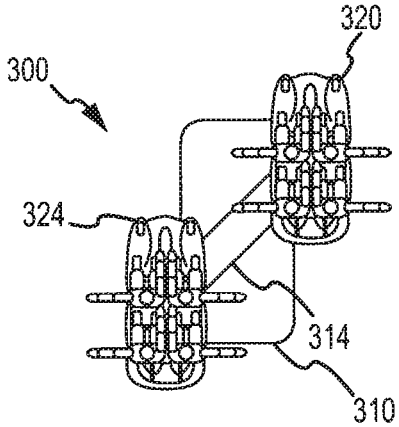
Figure 3F:
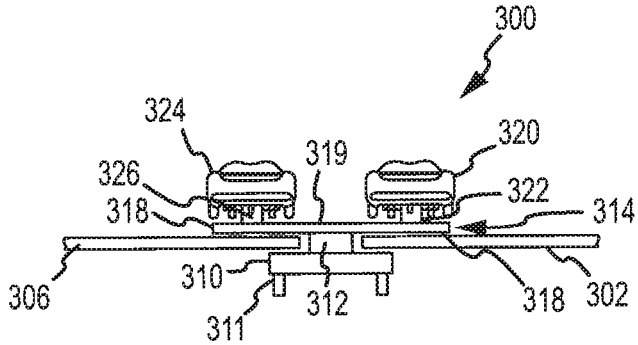
Figure 3G:
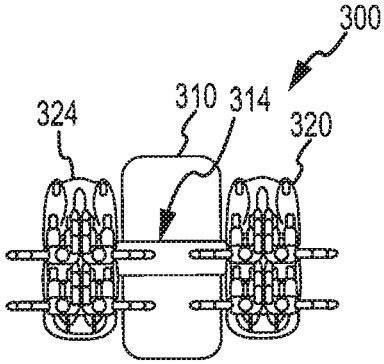
Figure 3H:
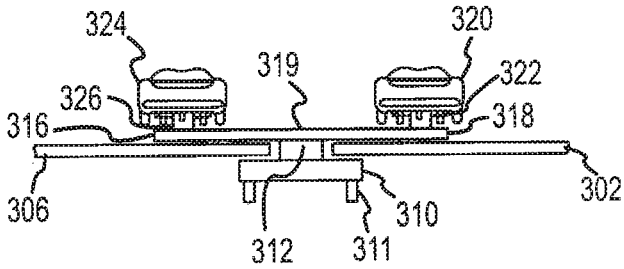

FIGS. 3E and 3F illustrate a later stage or permutation of the race for the ride system 300 in which the trailing car 324 is attempting to pass the leading car 320 (or the car 320 has just passed the car 324 in other cases). This position is achieved by the arm 314 being further rotated (e.g., from 0 to 20 degrees as shown in FIG. 3C to 35 to 60 degrees as shown in FIG. 3E) such as by rotation of the pedestal 312 or a driver/transmission device in the pedestal 312 about the axis 319. This causes the relative positions of the vehicles 320, 324 to be modified further and, in this example, for the trailing vehicle 324 to further gain or pass the leading vehicle 320 (e.g., for the distance between the fronts of the vehicles to decrease further in magnitude). Again, the vehicles 320, 324 are rotated on the mounting elements or pedestals 322, 326 (e.g., concurrently with each other and with the arm 314) such that they remain facing forward or along the track/direction of travel for the ride 300. FIGS. 3G and 3H illustrate a side-by-side position such as may be created to simulate a close race between two vehicles 320, 324 (e.g., a photo finish, an even point in the race, an even starting point, or the like), to simulate a half way point of a passing maneuver or permutation, and/or to place passengers in a desired show/display position to view a scene or the like. This position is achieved by rotating the arm 314 further from the inline, move, and passing positions such as to a position where the arm 314 is transverse to the direction of travel of the chassis (or the track), e.g., is at about 75 to 105 degrees offline. From the side-by-side position, the vehicles 320, 324 may be returned to the passing position shown in FIGS. 3E and 3F or the previously trailing vehicle 324 may continue to pass and placed ahead of the other vehicle 320 (e.g., in a passing position, a move position, or an inline position as shown (or on the other side of vehicle 320)).

Generally, one aspect of embodiments of the invention is that the support used to physically support and position two or more racing or matched vehicles in a ride is pivotably mounted upon a common or single chassis. Further, it is desirable that the vehicles rotate or pivot concurrently with the support on the chassis such that orientations can be controlled and, in some cases, altered during a ride (e.g., with each vehicle having the same orientation throughout a ride, with at least some of the vehicles having differing orientations such as one vehicle losing control and spinning on its axis or such as two vehicles having differing orientations to view differing show features, and so on). This may be achieved in numerous fashions and the invention is not limited to a specific technique. Generally, these functions are achieved with a drive system or assembly that includes a driver or drive mechanism that acts to rotate a pedestal supporting the support or support arm (e.g., a drive provided on or in the chassis that acts to support and to selectively rotate the pedestal, which is, in turn, linked to a drive element in the arm) or to rotate/pivot a central drive portion of the arm (e.g., an electrical, mechanical, or combination drive or transmission element provided in or through the pedestal to drive a gear, pulley, or the like in the arm and, typically, also linked to the arm or aim housing). Those skilled in the arts will readily understand numerous implementations for such a drive system or assembly for the support and the vehicles on the support. However, it may be useful to describe at least two exemplary ways to provide the selective rotation/pivoting or "positioning" functionality of the present invention.

Figure 4:
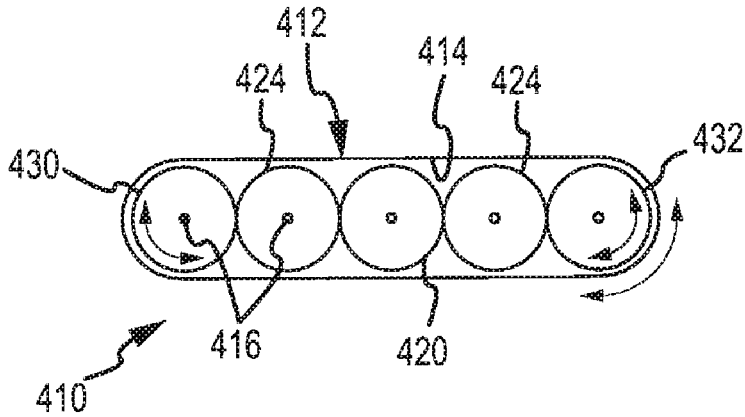
FIG. 4 is a top view of a vehicle support arm (or positioning arm or rotatable/pivotable arm) with an upper wall or the arm housing removed to show a drive or positioning assembly, which in this case is a gear assembly, used to allow the arm to pivot or rotate about a central point (e.g., a central axis of a pedestal) while also pivoting or rotating the supported vehicles relative to each other and the track.

FIGS. 4-7 illustrate a racing ride system 500 that utilizes a gear train-type drive assembly 410 to rotate or pivot a support arm (or, simply, support) 412. As shown in FIG. 4, the assembly 410 includes the support 412, which has an elongate housing 414. Within the housing 414, a series or plurality of gears are provided that function collectively to convert an input driving force into forces that cause the body or housing 414 to rotate about a center axis and also to cause a pair of vehicles to rotate (e.g., concurrently with each other and the arm and, in some cases, at the same rate and in the same amount). In the illustrated embodiment, the gear train-based drive assembly 410 includes a centrally positioned drive gear 420, and this drive gear 420 is linked through drive shaft or pin 539 to a driver or drive mechanism 536, which in turn is mounted upon a common chassis 530. In this case, the drive mechanism 536 supports and selectively rotates a pedestal 538, and the drive shaft 539 is rigidly attached to this pedestal. In other cases, the pedestal 538 includes a driver to rotate the shaft 539, and in yet other cases, the drive mechanism 536 transmits rotation through a transmission system/device provided in the pedestal 538. To cause the arm 412 to rotate with the drive gear 420, the body 414 may be attached or linked to the gear 420 or, in some cases, to the drive shaft 539. In some preferred embodiments, gear 420 is rigidly attached to chassis 530. As arm 412 is rotated, gears 424 "walk" around stationary gear 420, which causes rotation of gears 430 and 432 that are attached rigidly to the vehicles 544 and 540.

Figure 5:
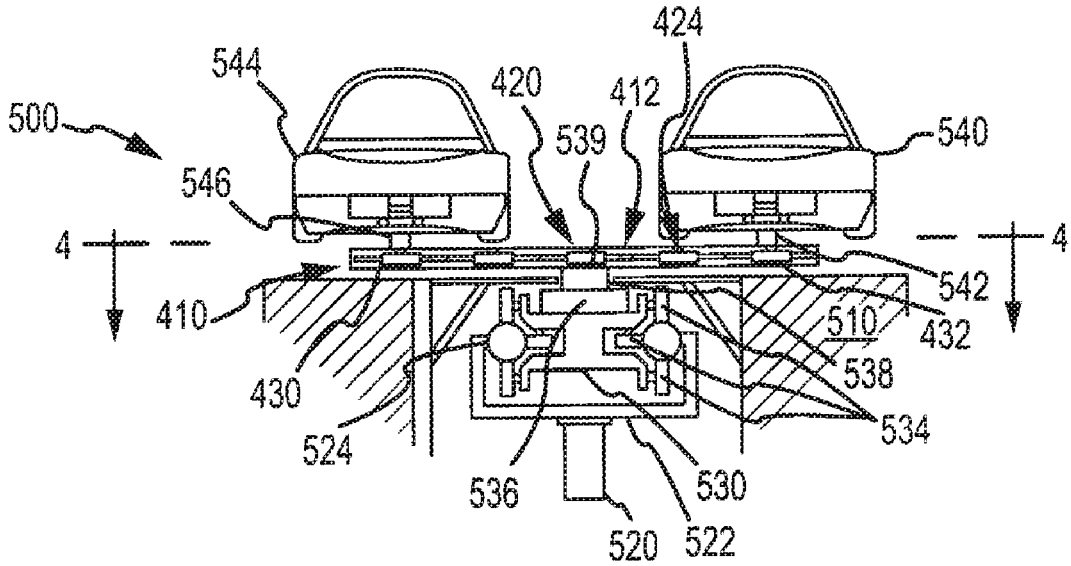
FIG. 5 illustrates an end view of a ride system or assembly including the vehicle support arm of FIG. 4 to selectively position vehicles in a variety of race or ride positions.
Figure 6:
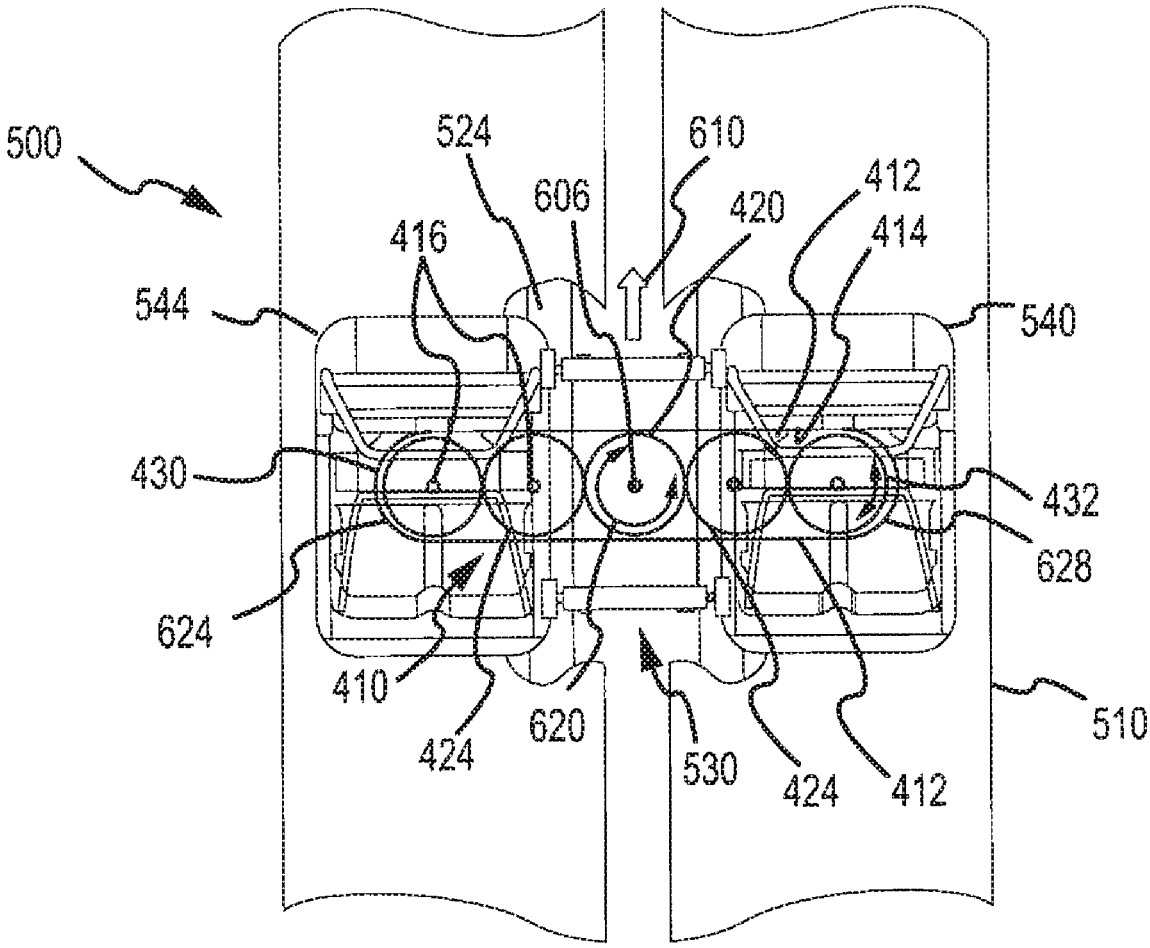
FIG. 6 illustrates a top, partial cutaway view of the ride system of FIG. 5 showing the support arm and attached vehicles in a side-by-side position (e.g., one vehicle passing the other, a race start position, or the like)
Figure 7:
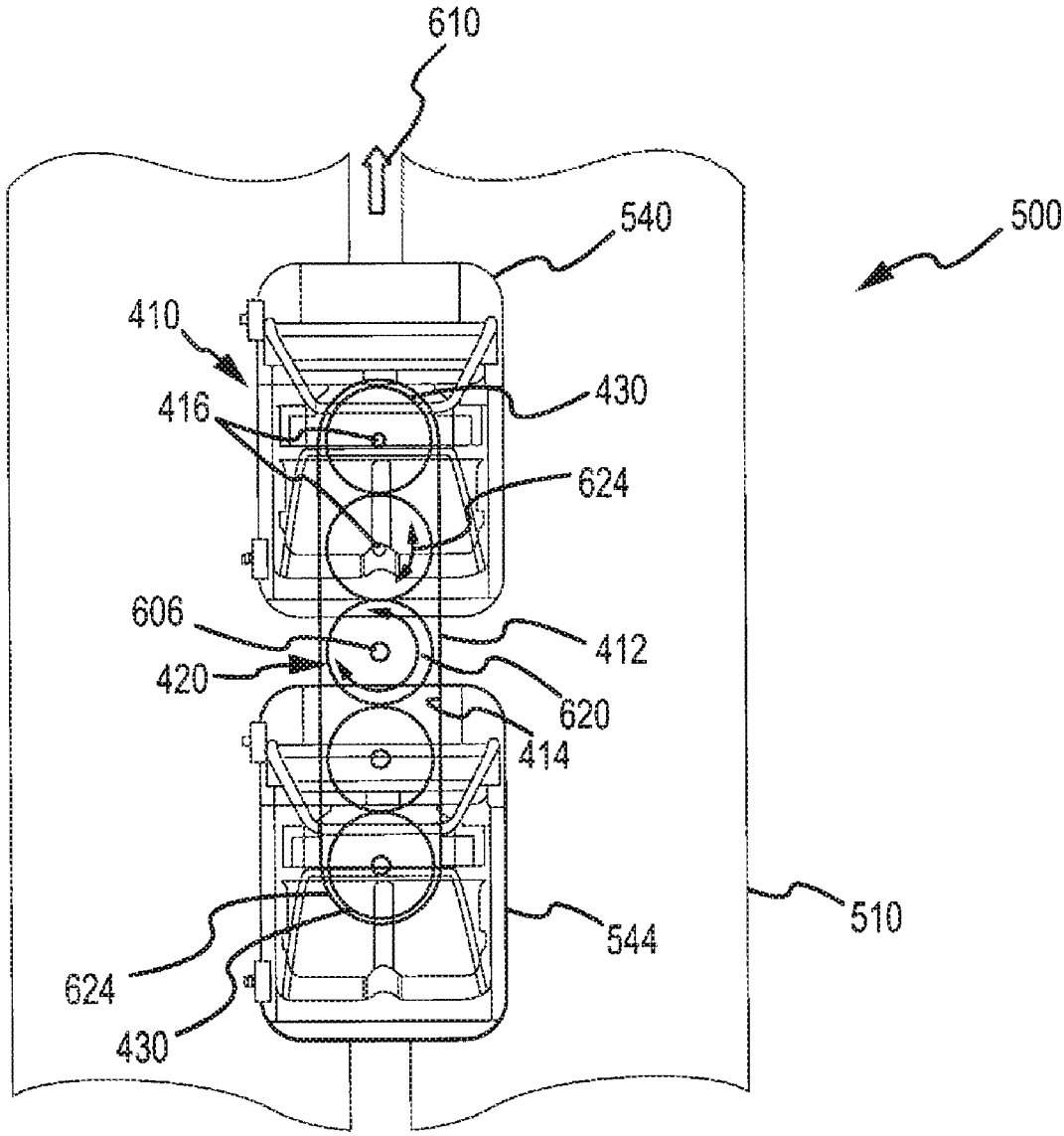
FIG. 7 is a view similar to that of FIG. 6 illustrating the ride system in another race or ride position provided by the support arm and a pedestal drive/rotation mechanism, e.g., with the two vehicles in an inline position (one behind the other) such as after or before a passing section of the ride.
Figure 8:
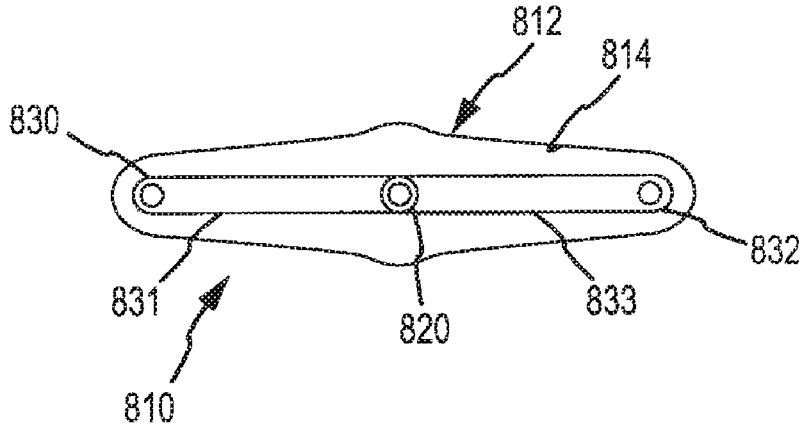
FIGS. 8-11 illustrate, with illustrations similar to those of FIGS. 4-7, another ride system or assembly embodiment of the invention showing use of a support arm housing a belt and pulley drive assemble for providing desired rotation or pivoting of the support arm and relative positioning of two supported ride vehicles.
Figure 9:
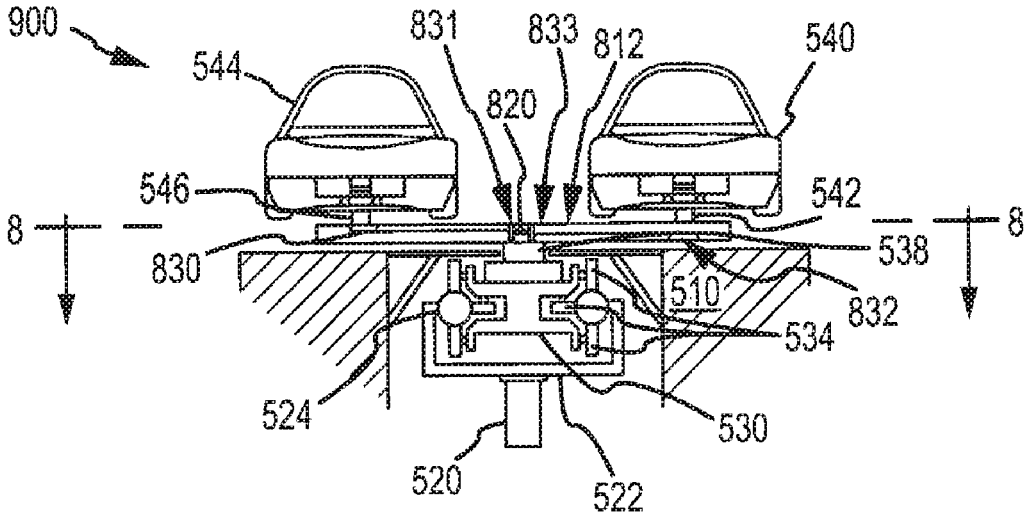
Figure 10:
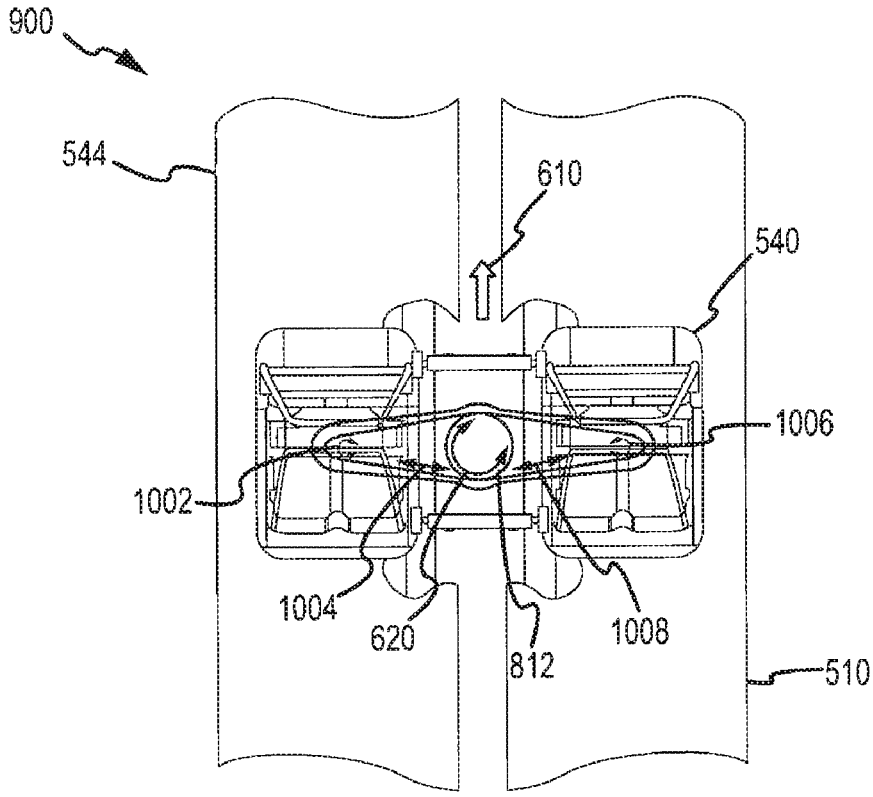
Figure 11:
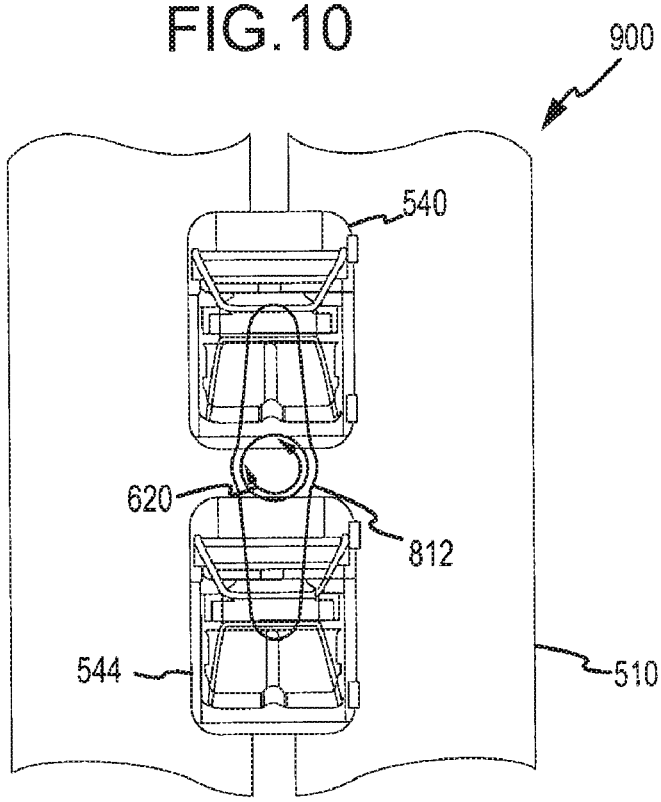

In any of these drive input embodiments, the support 412 rotates about a central axis 606 as shown with arrow 620 in FIG. 6 when driven or rotated/pivoted by the input driving force (e.g., from driver 536 or the like). In other words, arrow 620 is generally meant to indicate that the entire arm or support 412 is rotated by drive mechanisms/assemblies while drive gear 420 typically (but not for all embodiments) remains fixed in place and does not rotate. For example, FIGS. 5 and 6 illustrate the support being positioned transverse to a travel direction 610 of the common chassis 530 or ride assembly 500. FIG. 7 illustrates the support after rotation 620 about the axis 606 in an inline position with the support arm 412 generally inline or parallel to the direction of travel 610. The racing ride system 500 further includes a pair of racing vehicles 540, 544 that are attached to the support via mounting elements or pedestals 542, 546. When the support 412 rotates between the transverse (or, in some cases, orthogonal) position shown in FIGS. 5 and 6 to the inline position shown in FIG. 7, the vehicles 540, 544 are also moved, i.e., from a side-by-side (or passing/move position) to an inline position (or leading/drafting position).

Rather than having the vehicles 540, 544 locked in a single orientation on the support 412, the driving assembly 410 is configured to pivot/rotate the vehicles 540, 544 as shown with arrows 624, 628 in FIGS. 6 and 7. Such pivoting/rotating 624, 628 of the vehicles 540, 544 allows the vehicles and their passengers to have a desired orientation such as facing forward or along the line of travel 610 throughout (or at least in some portions of) the ride or operation of system 500. With reference to FIG. 4, such concurrent rotation of the support 412 and vehicles is achieved with the connection of a pair of driven gears 430, 432 that rotate about pins/shafts 416 and are linked to the central drive gear by a pair of idler gears 424 (which are allowed to freewheel on mounting shafts/pins 416 that are in turn attached to housing 414). The idler gears 424 rotate in response to rotation of arm 412 about the drive gear 420, which is fixed to the chassis 530. The driven gears 430, 432 are rotated as their teeth engage the teeth of contacting and adjacent idler gears 424. The vehicles 540, 544 rotate with the driven gears 430, 432 because these gears are rigidly linked or fixed to the vehicles 540, 544 via mounting elements or pedestals 542, 546 (which may be attached to the top surface of the gears 430, 432). All of the gears in the assembly 410 may be the same size as shown and are positioned to be able to freely rotate within support housing 414. Of course, differing gear arrangements/trains may be used to obtain a desired rotation of the support 414 and support vehicles 540, 544 with equally sized gears being useful in obtaining a similar or matching, concurrent rotation or pivoting of the vehicles 540, 544 such that each vehicle has the same orientation (e.g., facing forward as a car would during a race). In other embodiments, clutches and other devices may be used to allow one vehicle to be rotated without the other rotating and/or to cause one vehicle to have a different orientation relative to the other (such as with one at zero degree yaw relative to the direction 610 and the other to have a yaw of up to 45 to 90 degrees or more).

As shown in FIG. 5, the support 412 is mounted in the ride system or assembly 500 such that the central drive gear 420 is supported on shaft 539 and pedestal 538 (e.g., with drive gear rigidly attached to chassis 530 or the like). The ride platform or structure 510 is configured with two halves or with a track trench/pit and its platform includes a groove or opening for the pedestal 538 to pass unobstructed during operation of the ride system 500. Within the platform 510, the common chassis 530 rides upon a track 524 such as with wheels, caster, rollers, or the like 534. The track 524 is supported within the pit/trench of platform 510 with supports 520 and track frame/joists 522. Of course, many other track/platform arrangements may be used to practice the invention with the arrangement of FIGS. 5-7 only one useful example, and these figures are provided more to show use of a common chassis 530 to support and drive the drive assembly 410 than to show a track arrangement. During operation of system 500, the chassis 530 travels along the track 524 (with motive force provided to the chassis 530 in any of a number of ways that are well known to those skilled in the arts of ride design and similar technical arts) and the support 412 and supported vehicles 540, 544 are propelled along the course of the track platform 510. The drive mechanism 536 is selectively operated to rotate the pedestal 538, which causes the gear 420 and support 412 to rotate 620 about axis 606 and concurrently for gears 430, 432 and attached vehicles 540, 544 to rotate 624, 628. In this manner, the support 412 and vehicles 540, 544 may be placed in the positions shown for the ride systems of FIGS. 1-3 using a mechanical or gear-based drive assembly 410.

FIGS. 8-11 illustrate another racing ride system 900 with like components from system 500 having like numbers. As with system 500, the ride system 900 is adapted to simulate a racing environment in which the vehicles 540, 544 are selectively positionable 360 degrees about a central axis of a support arm 812 such that they can be side-by-side or inline (with either car leading or following or on either side of the line of travel 610). Instead of a gear-based drive assembly 410, the ride system 900 includes a drive assembly 810 that is adapted to use drive belts, cables, or chains and pulleys to position the support 812 and support vehicles 540, 544. As shown, the drive assembly 810 includes an elongate support or support arm 812 with a housing 814. In the housing 814, the assembly 810 includes a central drive member or pulley 820. As with the drive gear 420, the drive pulley 820 is affixed to and supported upon drive shaft or pin 539, which in turn is attached to pivotable pedestal 538 that is selectively positioned by driver or drive mechanism 536. The pulley 820 (or the drive shaft/pin 539) is also attached to the housing 814 such that the support 812 moves with the pedestal 538. The drive mechanism 536 is positioned upon a common chassis 530 that rides on track 524, and, hence, the support 812 travels along the track platform 510 with the chassis 530 in a position relative to the drive direction 610 that is defined by the drive mechanism 536 (e.g., in response to control signals from a control system provided on board such as within the chassis 530 or drive mechanism 536).

The central pulley 820 is connected to two driven pulleys 830, 832 via two drive belts, cables, or chains 831, 833 (or chains or the like), all of which are positioned within the housing 814 so as to move with the support 812 (e.g., in response to rotation 620 of the pedestal 538). For example, the pedestal 538 may be rotated 620 about its central axis so as to move the support arm 812 from the position shown in FIG. 10 to the position shown in FIG. 11. Typically, pulley 820 is rigidly attached to the chassis 530 and does not rotate. Then, rotating arm 814 causes relative movement between fixed pulley 820 and pulleys 830 and 832. In some embodiments, though, rotation of the drive pulley 820 may be used to cause the drive belts 831, 833 to move, and in response, the pulleys 830, 832 (which are mounted to be able to move independently of the housing 814) rotate about their axes or mounting shafts. The vehicles 540, 544 are rigidly attached to the pulleys 830, 832 via mounting elements 542, 546 such, that the vehicles 540, 544 rotate 1002, 1006 as the belts 831, 833 move (as shown with arrows 1004, 1008). In some embodiments, the pulleys 830, 832 are selected to have the same size/diameter and to be driven by similar belts 831, 833 such that the rotations 1002, 1006 are not only concurrent but are also of the same or nearly the same magnitude to cause the vehicles 540, 544 to maintain a consistent relative orientation (e.g., parallel to the travel direction 610 or the like). Again, as with system 500, clutches and other devices may be used to allow the pulleys 830, 832 to rotate independently (or non-concurrently) or to rotate at different speeds or in differing amounts (e.g., to cause the vehicles to have differing yaws/orientations). Also, while three pulleys and two belts/chains are shown, those skilled in the art of such drive devices will readily recognize that many other configurations may be used to achieve the functionality of having the arm 812 rotate with pedestal 538 (or with shaft 539) and having this cause pulleys 830, 832 to rotate in a desired manner (to selectively pivot/rotate the vehicles 540, 544) during operation of the system 900.

From the above description, the usefulness of providing a ride assembly or system with a rotatable/pivotable vehicle support can readily be understood. Generally, such assemblies or systems will include a support (such as an elongate support arm or span beam) that pivots or rotates about a common (or, sometimes, central) rotation axis. The support may be mounted upon a chassis or body that can be moved within the ride system such as along a track. Further, two or more vehicles (e.g., any body, bench, seating assembly, or the like for carrying guests or passengers) mounted upon or physically supported by the support structure, and the vehicles are also pivotably or rotatably mounted. In some cases, the vehicles or passenger-carrying bodies are rotated concurrently with each other and also with the support (e.g., about axes extending through their mounting element and, in some cases, these axes are parallel with each other and with the common axis about which the support rotates).

In addition to the applications shown in FIGS. 1-11, such a pivotable vehicle support may be useful to solve or address other ride design problems. For example, there is an increasing use in new rides and attractions of 3D and projected sets in many theme or amusement parks. In such rides, it is important to locate all guests in the vehicle/conveyance device as close to the virtual focal point as possible in order to provide a desirable viewing experience. Unfortunately, this can create an extremely difficult loading scenario requiring significant operator costs and/or expensive facility infrastructure in order to get guests placed in ideal seating locations, such as multi-tier/level seating similar to stadium theater seating.

Figure 12:
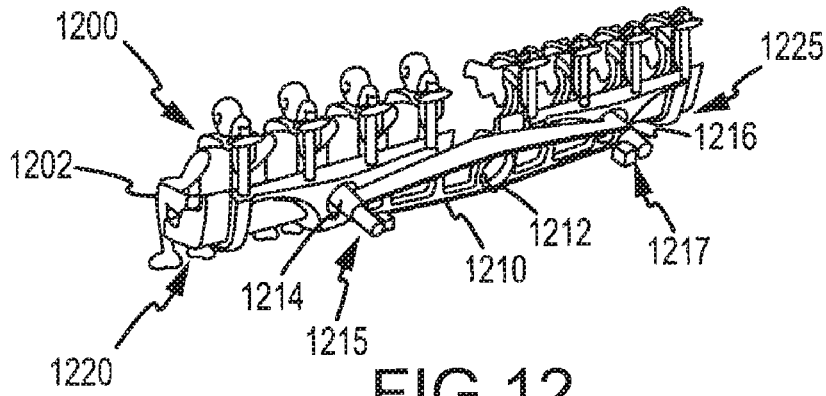
FIGS. 12-14 illustrate another embodiment of a ride system of the invention illustrating the concept of vehicles pivoting about a central axis on a support aim to facilitate single level loading and then placing the vehicles in a ride configuration/position with seating on two or more levels.
Figure 13:
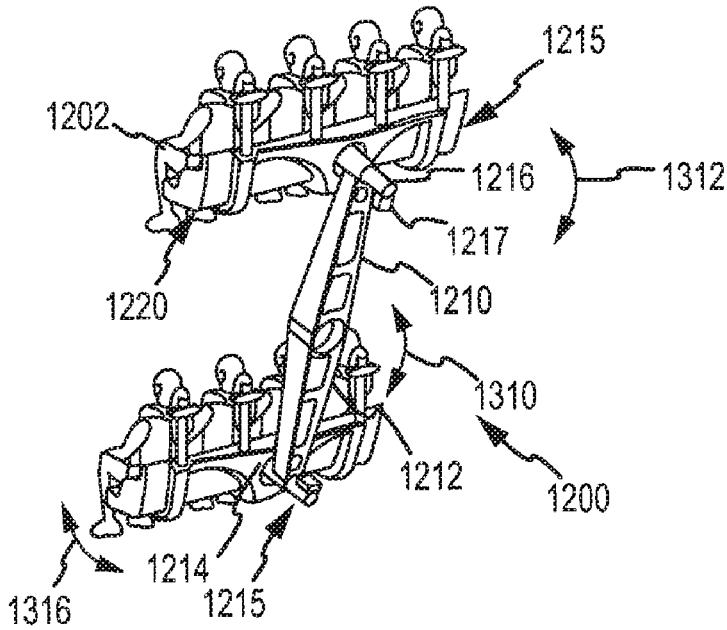
Figure 14:
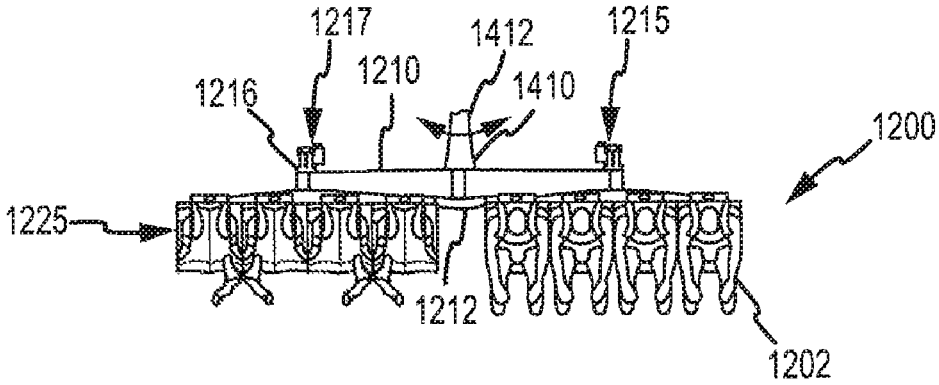

FIGS. 12-14 illustrate a portion of a ride/vehicle system 1200 that makes use of the pivotable support concept to provide a way to allow guests 1202 to load on a level surface at a single elevation. Then, in an initial move or at a show portion of the ride, the seats/vehicle with the seats, may be moved into a more compact formation with multi-tiers/levels that positions the guests 1202 with their eyes at or near a designed virtual focal point for the show. FIG. 12 illustrates the ride system/assembly 1200 in a load/unload position. The system 1200 includes a support or span beam 1210 with a drive or mounting assembly or mechanism 1212 that, typically, would be attached to a drive mechanism (e.g., via pedestal or drive shaft 1410) provided on or support by a common chassis or body (not shown but linked) for moving and positioning the guests 1202 in various locations about a ride course or track. The drive mechanism 1212 is attached to the support or span beam 1210 and is operable to rotate or pivot the support 1210 about a central or common rotation axis as shown with arrows 1310 in FIG. 13 and 1412 in FIG. 14.

The system 1200 further includes mounting elements 1214, 1216 for attaching a pair of vehicles or passenger-carrying bodies 1220, 1225 to the support or span beam 1210. Further, a pair of drive mechanisms 1215, 1217 is provided to selectively rotate or pivot the mounting elements 1214, 1216 (e.g., concurrently or independently) and attached vehicles 1220, 1225 about axes extending through the mounting elements 1214, 1216 (e.g., axes parallel to each other and to a central or common rotation axis extending through the drive assembly 1212 (e.g., an axis of the shaft 1412)). In FIG. 12, the ride system 1200 is shown in a load/unload position with one elevation for the vehicles 1220 and 1225 (or with the two vehicles aligned in a straight line). FIG. 14 provides a top view of the ride system 1200 in this same position in which the vehicle 1225 has been unloaded (or not yet loaded) showing rotation 1412 of the support 1210 (and attached vehicles 1220, 1225) about the shaft 1410 by a drive mechanism (not shown). FIG. 13 illustrates the ride system 1200 after rotation 1310 about its common rotation axis into a show position in which the vehicles 1220, 1225 are placed at two elevations or in two tiers but kept in a fairly tight formation of guests such that a center focal point can be provided (such as near the rotation axis through drive assembly 1212). To maintain an upright, seated guest position, the vehicles 1220, 1225 are also rotated/pivoted 1312, 1316 about their mounting elements 1214, 1216 (e.g., by operation of the drive mechanisms 1215, 1217). Typically, such rotation 1312, 1316 is performed concurrently and also concurrently with the overall or beam rotation 1310.

The driving assembly/system provided by the combination of the span beam and rotatable vehicles enables a compact ride configuration while maintaining traditional level loading. To this end, the system 1200 provides a mechanism to stack the gondolas or vehicles after loading/dispatch into the ride. The illustrated system 1200 provides a dual motor-gearbox solution (e.g., with mechanisms 1215, 1217), with synchronized control provided when it is desired to provide concurrent rotation of the gondolas/vehicles 1220, 1225. At the ends of travel (e.g., in the positions shown in the figures), positive detent plungers or other devices may be included to engage and prevent motion of the gondolas/vehicles 1220, 1225 with respect to the span beam/support arm 1210. The mechanisms 1215, 1217 may be counter-rotating motors that index the seats 1220, 1225 opposite the center pivot 1212 so as to keep the seats substantially level during reconfiguration from loading/unloading as shown in FIG. 12 to ride/show configuration as shown in FIG. 13 (or vice versa) (although some rides may use independent or unsynchronized motion 1312, 1316 as a show/ride element). In one embodiment of system 1200, reconfiguration or selective positioning is achieved through a single center axis rotation with the seats/vehicles 1220, 1225 being connected with a mechanical linkage (e.g., as shown in FIGS. 1-11 or the like that may provide a 1:1 rotation between the seats 1220, 1225 and the center axis 1212 and attached aim 1210). Likewise, the systems shown in FIGS. 1-11 may be modified to use synchronized motors or other drive mechanisms to drive the two or more vehicles mounted on the supports.

Figure 15:
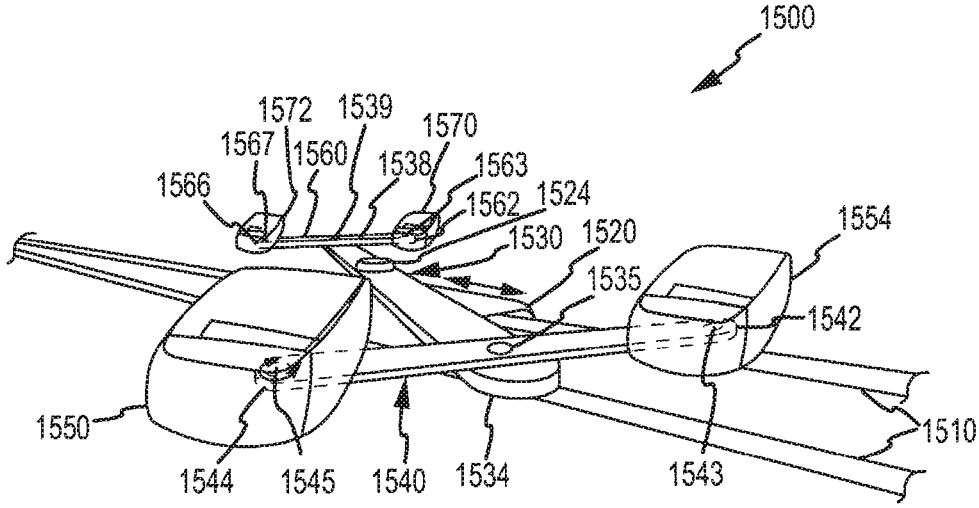
FIG. 15 illustrates schematically or in simplified form another ride system of the invention in which the concepts shown in FIGS. 1-14 are expanded upon to provide a multi-support arm and, hence, multi-vehicle ride.

The system 1200 of FIGS. 12-14 is useful for showing that the concepts of the invention are useful for more than just pure racing between two vehicles. Instead, the concepts may be used to provide selective positioning of vehicles in not just the horizontal plane but also in a vertical or nearly vertical plane such as shown with system 1200. Also, the concepts of selective positioning with movement along with a common chassis can be expanded to multiple vehicles. For example, FIG. 15 illustrates a "racing" ride system 1500 of another embodiment. In this embodiment 1500, a track 1510 is provided that supports a common chassis 1520 that may move along the track such as by motorized rollers or the like riding on or against the track 1510. A drive gear/pulley 1524 extends outward from the chassis 1520, and the chassis 1520 contains or provides a driver or drive mechanism for this gear/pulley 1524 (as explained in details with FIGS. 1-14 or the like). A span beam or support 1530 is attached to the drive gear/pulley 1524 and is selectively pivoted or rotated about an axis of the gear/pulley 1524 such as to rotate up to 360 degrees on the chassis 1520.

Instead of a single vehicle mounted on each end of the beam 1530, the system 1500 is configured with two additional or end span beams/support arms 1540, 1560. These arms 1540, 1560 are supported on the main support arm 1530 near opposite ends 1534, 1538 and are attached (e.g., at or near a central axis) to a pair of driven gears/pulleys 1535, 1539 (e.g., driven portions of a drive assembly as discussed with reference to FIGS. 1-11 or the like). The aims 1540, 1560 are selectively rotated about the gears 1535, 1539 such as concurrently with the arm 1530 and with each other (or, these can be rotated independently or one rotated with the arm 1530). In one embodiment, the driven gear 1535, 1539 is also a central drive gear for a drive assembly provided in the corresponding arms 1540, 1560. In this manner, each of the arms 1540, 1560 may support on opposite ends (1542, 1544) and (1562, 1566) a pair of vehicles (1550, 1554) and (1570, 1572), with a pivot or driven gear pairs (1543, 1545) and (1563, 1567) being used to rotate the vehicles in response to driven and driver gears 1535, 1539. System 1500 is useful for illustrating that the selective rotation of supports and supported vehicles by one, two, three, or more drive assemblies can be used for racing or relative positioning of 2, 3, 4, or more vehicles with travel along a single track/track assembly with a common chassis.

Figure 16:
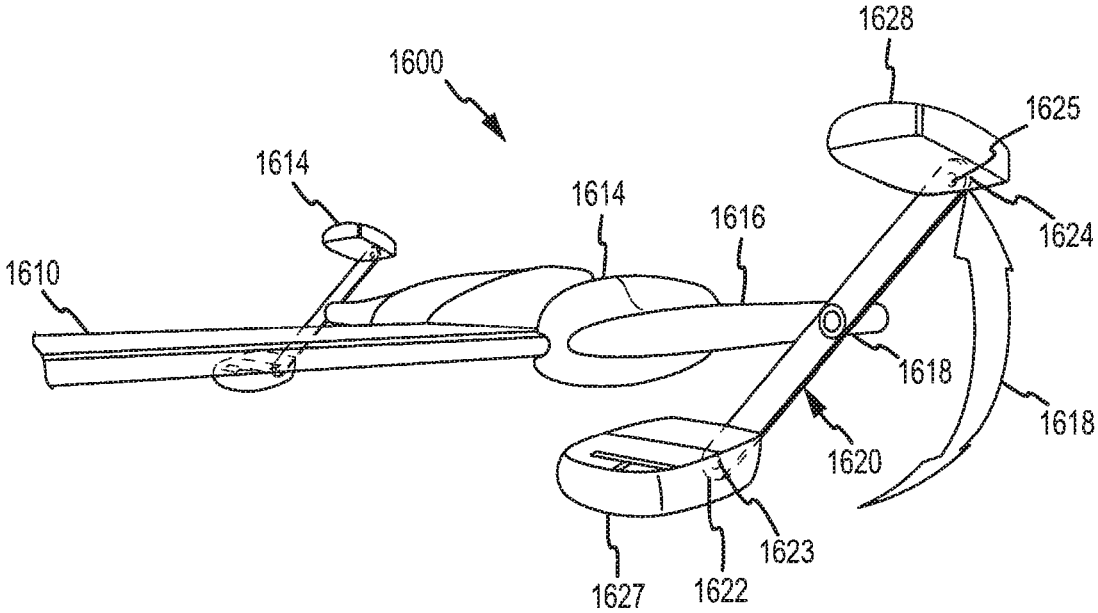
FIGS. 16-18 illustrate three additional embodiments of ride systems of the invention utilizing a support arm configured for rotating about its central point or axis to pivotably supported vehicles and provide desired relative positioning of the vehicles.
Figure 17:
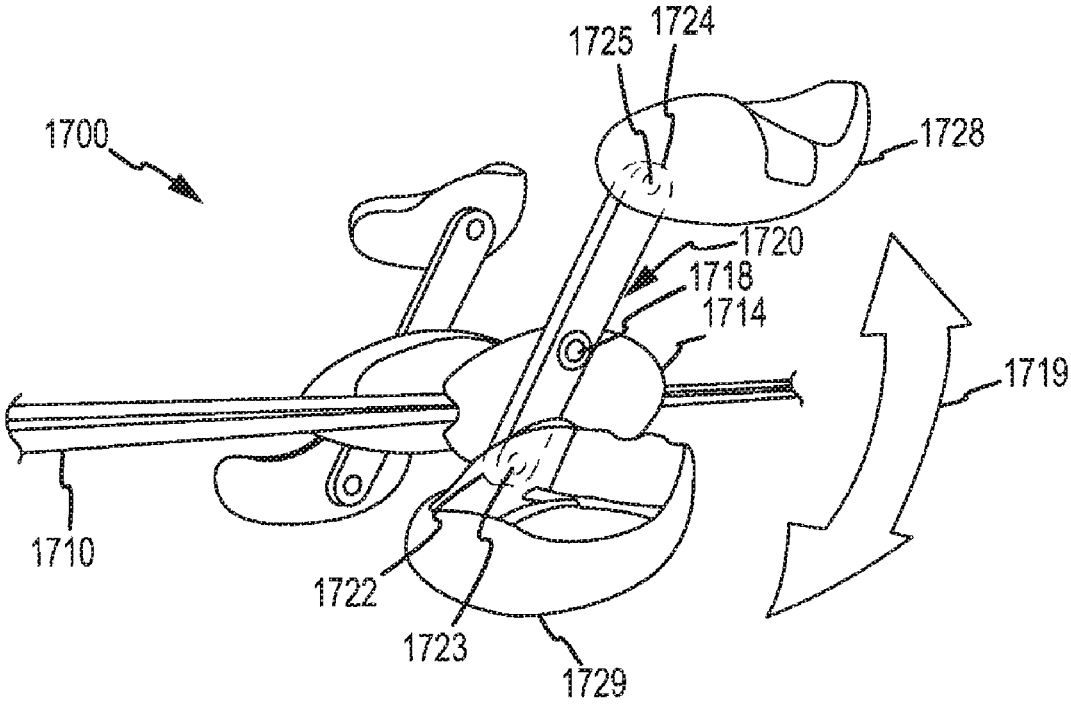
Figure 18:
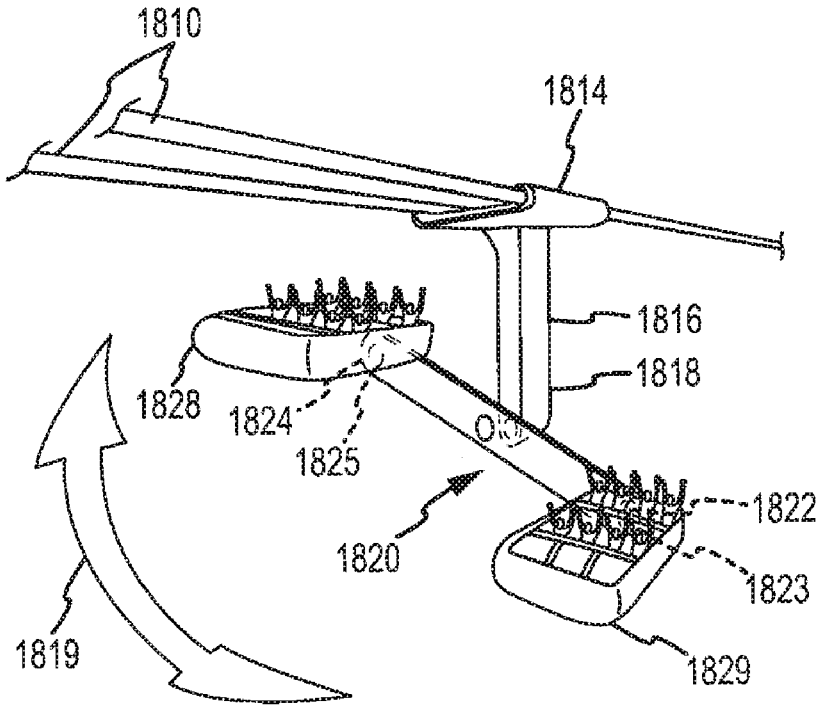

Other configurations of ride systems are provided in FIGS. 16-18 showing exemplary arrangements for providing rotating or positionable vehicles with a common chassis. In FIG. 16, the system 1600 includes a track 1610 upon which a common chassis 1614 is supported and rides in a direction of travel. Four vehicles are provided for guests and the chassis 1614 includes a pair of extensions 1616 to position a support 1620 apart from the track 1610. The extensions 1616 typically include a driver or drive mechanism (not shown) near its end 1618 to selectively operate a drive assembly in the support 1620 (as discussed for other embodiments such as a gear train or pulley assembly). The support 1620 is rotated about an axis extending through the end 1618 transverse (or even orthogonal) to the extension 1616. At the ends 1622, 1624 of the supports 1620, vehicles 1624, 1628 are mounted upon elements 1623, 1625, which are caused to selectively rotate to provide a desired orientation of the vehicles 1624, 1628 (e.g., to rotate concurrently with each other and with the rotation 1619 of the support, arm, or beam 1620).

In a similar but differing embodiment 1700 shown in FIG. 17, a chassis 1714 rides upon a track 1710. Support arms 1720 rotates 1719 about drive shafts or mounting elements 1718, e.g., about an axis extending transverse (or even orthogonal) to the track 1710 when driven by driver or driver mechanism in the chassis 1714. The arms 1720 typically house drive assemblies (such as gear trains/pulley assemblies or the like) such that vehicles 1728, 1729 are rotated about mounting elements 1723, 1725 at the ends 1722, 1724 of the support arms 1720. The system 1700 is useful for selective positioning of four vehicles in differing horizontal planes relative to the track 1710, and the pairs of support arms may rotate together or independently.

In yet another embodiment 1800 shown in FIG. 18, a track 1810 supports a common chassis 1814 having an extension element 1816 projecting downward away from the track 1810. As with the systems 1600, 1700, a drive mechanism (not shown) is provided in the end 1818 of extension 1818, and a support arm 1820 is mounted, such as via a rotatable shaft connected to a drive gear or pulley in the arm 1820. The arm 1820 is rotated 1819 about an axis that is parallel to the track or direction of travel of the chassis 1814. At the ends 1822, 1824 of the support 1820, pivotable/rotatable mounting elements 1823, 1825 are provided to rotate or pivot vehicles 1828, 1829 (e.g., when the mounting elements 1823, 1825 are rotated by linked driven gears/pulleys as discussed above).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the support or span beams were typically illustrated as being relatively elongate members. In other embodiments the supports may have many different shapes such as a polygon, a disc, or the like. Also, each support was typically shown to be used to support a pair of vehicles that were rotated concurrently or at least partially independently. In other embodiments, though, three or more vehicles may be provided on the support and linked to the housed drive assembly such that these three or more vehicles may be supported on a common chassis and rotated with the support and also about their mounting point or an axis passing through the mounting element. Mounting point can obviously be located centrally or eccentrically. Also, the vehicles are shown with seating for passengers, but the vehicles only need to be able to receive such passengers and they may be restrained in any fashion desired and any position (e.g., the guests/passengers may be standing, in a reclined position, may be laying down or in a more prone position, and so on).

During a typical ride operation, the racing ride systems of the present invention may be configured with a variety of control systems (such as those that respond to passenger input or interaction with ride components) that selectively operate drive mechanisms to move the support (or supports) about its axis and the vehicles about their mounting element and its axis. The rate of rotation of the support and the vehicles may be varied widely to practice the invention, e.g., may be relatively slow to respond to guest interaction (or guest-influenced interactive competition between two or more vehicles) such as screaming, pedaling, acting, or the like or relatively quick such as to provide a quick pass or to avoid a ride structure such as a cave wall to add excitement/thrill. In some embodiments, the support will be aligned with the direction of travel (such as at loading and unloading, in narrow portions of the ride, and before and after passing/exchanging positions) such that the vehicles are inline. The support typically allows the vehicles to exchange positions from lead to follow in an inline position or from one side to another in side-by-side arrangements. The ride systems are adapted to provide fixed vehicle spacing as the vehicles are pivotably mounted on a mounting element on the support (with the mounting element rotated/pivoted by a drive assembly component such as a gear, a pulley, electric motor, or the like).

In addition to the mechanical linkages described (gear trains, belts, chains, etc.), all embodiments of this invention may be realized with synchronized electric, hydraulic, or pneumatic motors (or combinations thereof) that are linked with a control system or hydraulic or pneumatic tubing and/or manifolds. Also, in addition to the interactive reasons described above for moving the vehicles, there may also be preprogrammed story points that move the vehicles according to a predetermined or random profile, and such preprogramming may be provided with software and/or hardware that is accessed or operated by a control system apart from and/or on the ride assembly. The drive assembly may be active as described in most of the described embodiments with reference to the figures. However, the inventors understand that some preferred embodiments may utilize passive drive assemblies. A passive drive system would not be driven, and, for example, may have a free spinning bearing or other structure/components that allow the vehicles/system to rotate according to their own center of mass/gravity and forces of gravity. Another variation may be that a pivot point of the main support or support arm may be located on center (as generally shown in the figures) or may be off center (eccentrically located).

The specific operating parameters and specifications for the many components described herein are too numerous and may vary over wide ranges to create a desired ride design or effect. However, it may be useful to provide some exemplary, but not limiting, engineering and/or operating parameters or characteristics of ride systems incorporating the features/aspects described above. For example, ride speeds may vary from about 0 to 100 miles per hour and vehicle weights will vary or depend upon the number of passengers per vehicle with a typical ratio of about 600 pounds of vehicle weight per passenger (e.g., a two person vehicle may weigh about 1200 pounds). The chassis, support arm, drive assembly, and other components would be designed for these vehicle speeds and weights with reference to a particular or worst case course or track profile, and, as would be expected, the amount of torque or input force required of the drive mechanism will vary significantly depending upon the weights of the vehicles and other factors. The rotation rates for the supports or support arms typically will range from about 0 to 16 revolutions per minute. The support lengths or span again may vary depending upon the shape/size of the vehicles and the amount of space or real estate available for the ride but typically this length will range from about 6 to 30 feet when measured from vehicle pedestal to vehicle pedestal.

Figure 19:
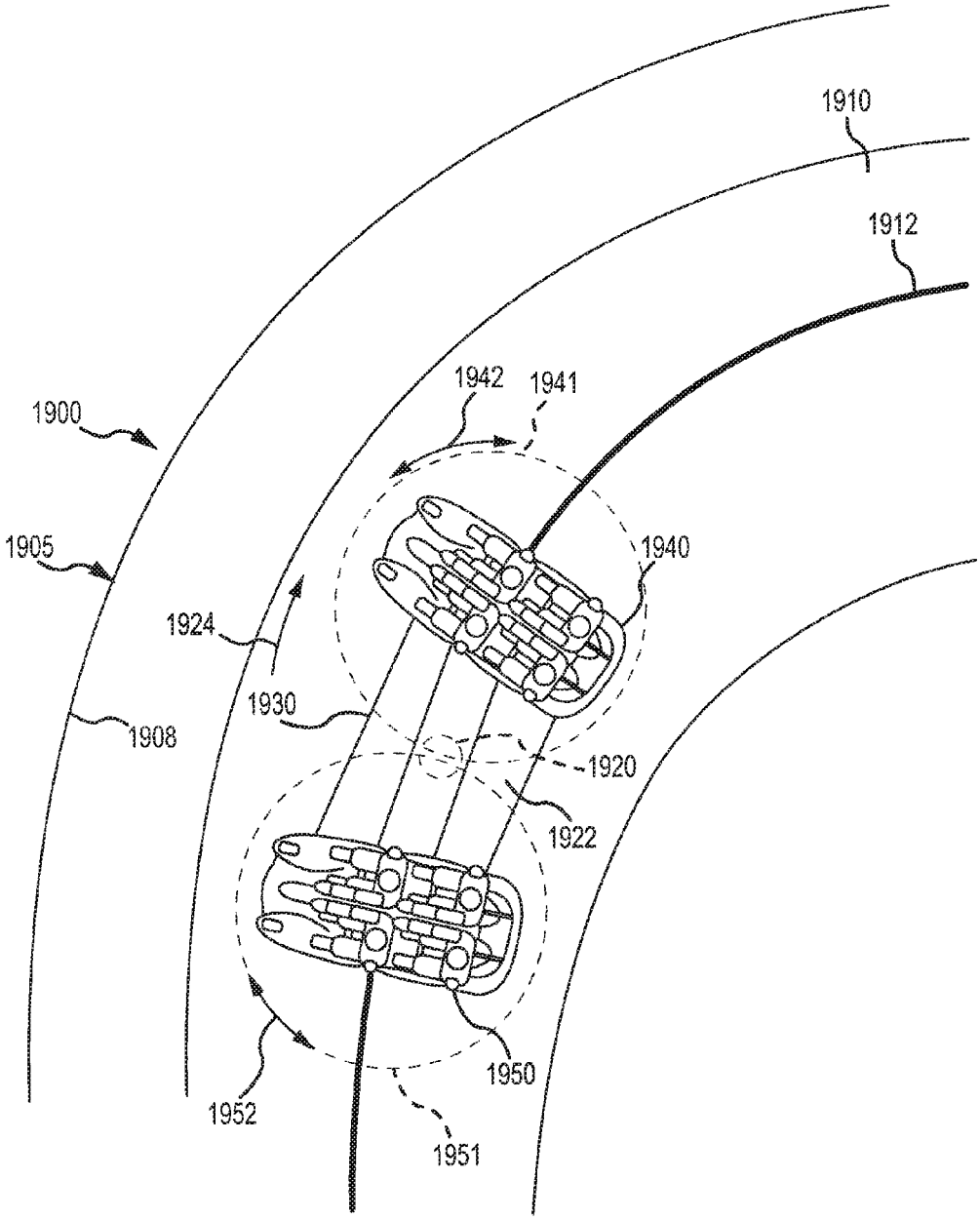
FIGS. 19-21 illustrate ride systems of an embodiment of the invention showing vehicles located in varying positions relative to each other including positions in which the vehicles are not parallel to each other.
Figure 20:
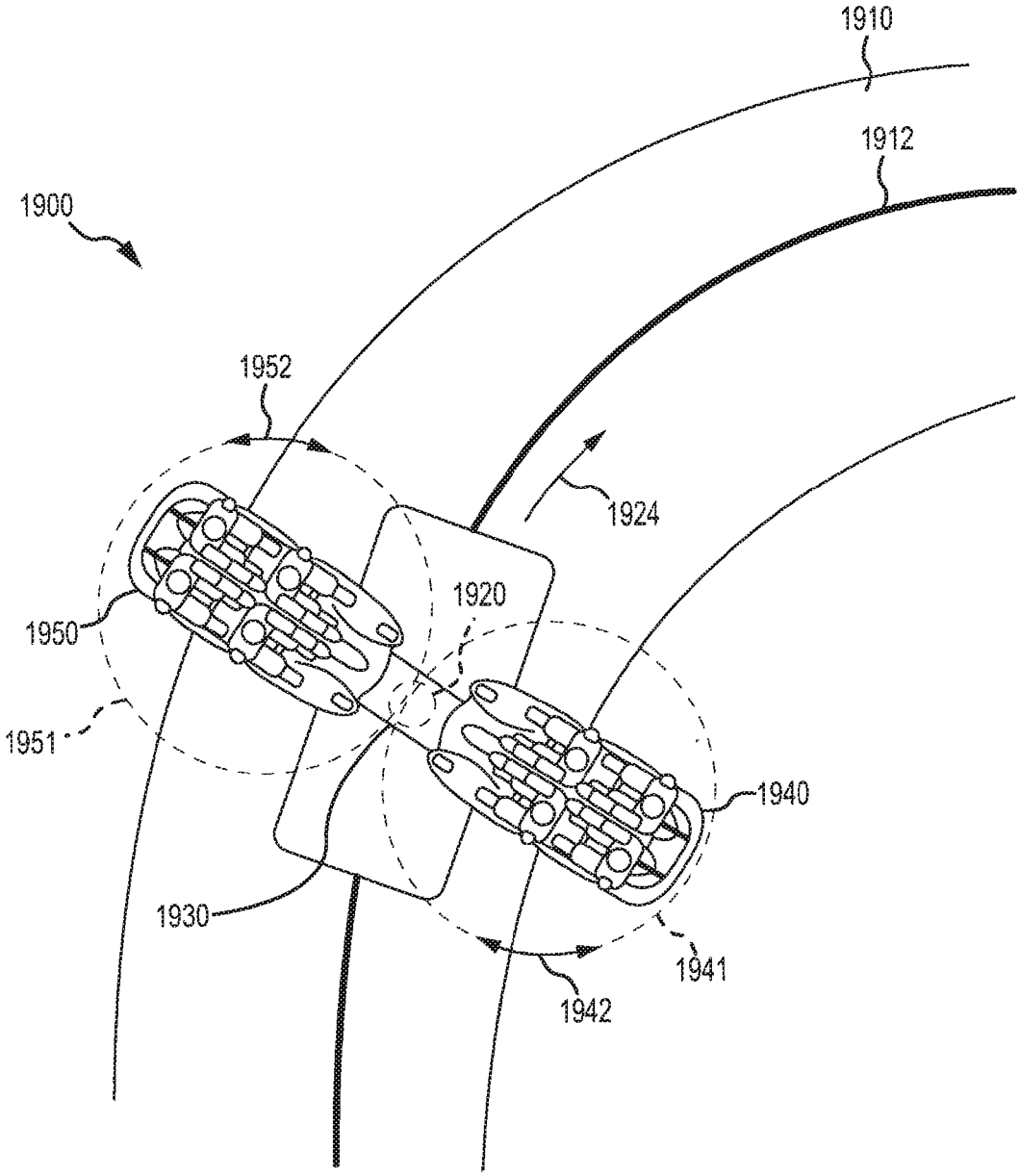
Figure 21:
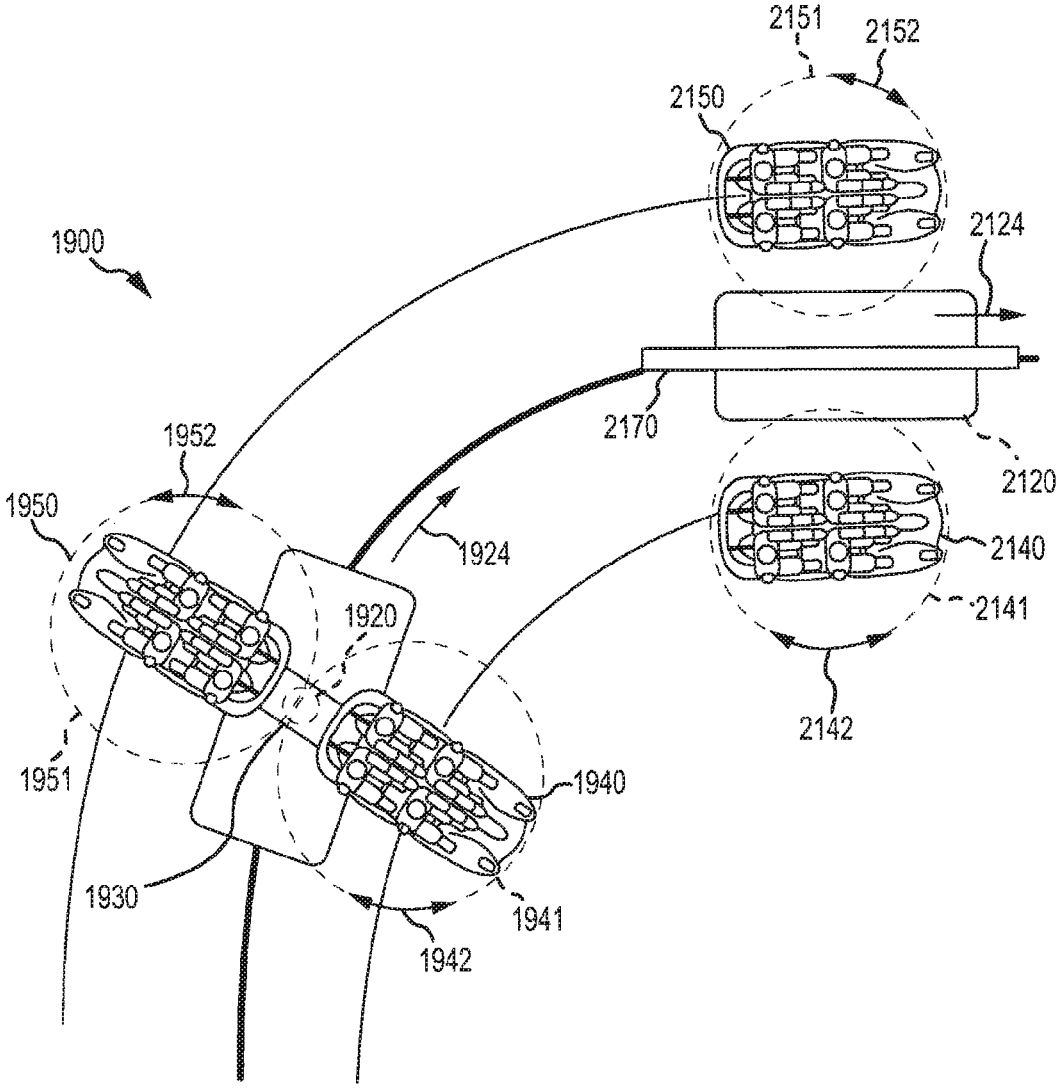

As further examples of variants or other embodiments of ride systems of the invention, FIGS. 19-21 are provided to illustrate a ride system or assembly 1900 in which vehicles may be moved or rotated on a support arm such that the vehicles do not remain parallel to each other. For example, the drive assembly may be configured such that the vehicles may be independently rotated and/or configured such that (at least in certain operating conditions) one of the vehicles rotates at a differing rate or amount so as to independently position each vehicle or at least vary the relative position from parallel (as shown in many of the other figures). These embodiments may be thought of as independent vehicle body orientation ride systems or assemblies, and such embodiments may be used to optimize show viewing of passengers, to increase interactivity between show elements and/or proximate/adjacent vehicles and their riders).

As shown in FIG. 19, the ride assembly 1900 includes a screen or show wall 1905 extending along a length of a ride/attraction platform 1910. Videos or other show elements may be displayed on or near the surface 1908, and, hence, it is desirable to rotate vehicles passing along the path 1912 (or gap in the ride platform 1910 for support pedestal 1922) to face passengers toward the displayed show elements. Since the path of the track 1912 is curved it is also desirable to change the vehicle orientation as the vehicle travels around the corner/curve and, in some cases, for each vehicle to be orientated independently so as to face more directly at a particular portion of the show surface 1908 on wall/screen 1905. To this end, the ride assembly 1900 includes a ride chassis 1920 positioned underneath the platform 1910 and moving as shown with arrow 1924 along a track/rail (not shown). A pedestal 1922 extends from the chassis 1920 to a support arm or platform 1930. As described above, the support arm 1930 may rotate (or be rotated about the central axis of the pedestal 1922 to position a pair of vehicles 1940, 1950, e.g., to adjust the vehicle positions relative to the chassis 1920 and to each other.

Additionally, though, each vehicle 1940, 1950 may be independently rotated (or at least at differing rates/amounts) from each other. This is shown in FIG. 19 in the system 1900 in which the chassis 1920 is traveling along a curved path/groove 1912. The support arm 1930 is rotated to a nonparallel position relative to the chassis 1920 to provide a first adjustment of the viewing position of the viewers/passengers in the vehicles 1940, 1950. But, further, the vehicles 1940, 1950 are rotated differing amounts so as to direct the front of each vehicle 1940, 1950 relative to the show surface 1908 (e.g., such that the front of the vehicles 1940, 1950 are more parallel to the surface 1908 although many other arrangements/positions may be provided). Such independent rotation/positioning is shown with a rotation/positioning area 1941, 1951 (e.g., a circular area or other area traveled by the vehicle body as they rotate about a mounting location on the arm 1930) and arrows 1942, 1952 indicating that travel may be clockwise, counterclockwise, or both directions. The rotation on the arm 1930 may be performed/controlled as discussed previously and, in some embodiments, the drive assembly may include a separate drive assembly/motor to provide the independent rotation (e.g., no gear/pulley mounting or these may be placed temporally in neutral to free spin or the like).

The ride system or assembly 1900 of FIG. 19 allows the vehicle bodies 1940, 1950 to be independently rotated for a desired show view based on vehicle/guest position in space such as to cause passengers to face a show or to move one vehicle out of the way of the other (e.g., so don't have to view show through other vehicle and its passengers). For example, an axis of the vehicle may be orthogonal to the show surface 1908. In other cases, the rotation 1942, 1952 may be performed so as to align the riders/passengers for moving eye point (3D) or align the riders/vehicle for differing perspectives or differing shows per vehicle (e.g., in contrast to the arrangement shown in FIG. 19 the vehicles may be placed and held at differing angles relative to the show so as to provide a show/ride experience that may vary each time the ride is enjoyed by the passengers). In some embodiments, the rotation 1942, 1952 of the vehicles 1940, 1950 is controlled and/or initiated by the passengers of the vehicles 1940, 1950, and in such embodiments, the rotation typically will differ for each vehicle.

FIG. 20 illustrates the ride system 1900 along a differing portion of the ride path 1912. At this location, the ride system 1900 is operated to place the vehicles 1940, 1950 in another orientation with the vehicles rotated independently or at least in differing directions (e.g., one clockwise 1942 and the other counterclockwise 1952 (or one at a faster rate or the like)). In this manner, group interaction of the passengers is increased or enhanced as the passengers in the differing vehicles 1940, 1950 are placed in facing or eye-to-eve orientation. Such an orientation may be used in a ride to allow passengers to see each other such as at the start of a ride to see the competing "team" of guests or during a ride to cause a dogfight situation such as during a battle-type ride. In other cases, such a positioning as shown in FIG. 20 places one (or both) of the vehicles 1940 or 1950 into the show from the other vehicle's vantage point or point of view (e.g., by placing show elements behind one or both of the vehicles 1940, 1950).

FIG. 21 illustrates the ride assembly 1900 in yet another length or section of the ride in which two differing sets (in this case, pairs) with the vehicles rotated differently to create two effects. In the lower left corner of FIG. 21, the vehicles 1940, 1950 are rotated independently (or at least in differing directions or at differing rates) such that the vehicles 1940, 1950 face away from each other with the vehicle passengers having their backs to each other. Such a position may be desirable to make the other vehicle seem to disappear such as to make a show element or portion seem more intimate or personalized (e.g., a show presented only to the riders of a single vehicle if shows are provided on both sides of the track).

Another pair of vehicles 2140, 2150 is rotated 2142, 2152 independently in rotation area/path 2151, 2141 on a support arm 2130. The support arm 2130 is mounted on a pedestal 2122, which in turn is supported upon a chassis 2120 traveling along the ride platform as shown with now 2124. In this case, the arm 2130 and the vehicles 2140, 2150 are rotated such that the vehicles are side-by-side and in a parallel arrangement with both facing the direction of travel 2124 (but could be somewhat off of parallel or transverse and/or be facing backward or away from the direction of travel 2124). To make the other vehicle 2140 or 2150 disappear from view a wall or blind 2170 is positioned between the vehicles 2140, 2150. The blind or wall may be suspended from above with a gap near the platform provided to allow the arm 2130 to pass with no or minimal contact. In this manner, the experiences of the passengers in each vehicle differ and interaction may be controlled as desired, such as to alternate visual contact and no visual contact.

As will be understood, the concepts described herein for ride assemblies and systems are well suited for nearly any type of ride that may be provided at a theme, amusement, or other entertainment facility or park. As described, the ride assemblies are very useful with roller coaster designs and applications to enhance rider experiences and control the positioning of the vehicles and passengers. The concepts described are also well suited for implementation in typical dark rides (T-rails and the like), in trackless rides/attractions, in robot platform-based rides, in carousels, in Ferris wheel-type rides, in boat and other "water" rides, and the like. In other cases, a combination of such ride-types may be used with the ride assemblies of the invention. For example, the ride assemblies described may be used in a tracked dark ride with a propulsion mechanism modeled upon or similar to a roller coaster with off-board drives.

As discussed and shown in detail the vehicles often will be maintained in a substantially parallel position and may be driven concurrently. In other cases, though, vehicle bodies may be rotated to place the vehicles at different rotation angles to make sure it is understood that this is also covered in this patent. Also, as discussed throughout the description, there are other mechanizations or drive assemblies besides the mechanical ones (e.g., gears, belts/pulleys, and the like) that may be used to provide the desired concurrent, differing, and/or independent rotation of the vehicles in embodiments of the invention. For example, these other mechanizations may include an electric drive per vehicle body and/or an electric drive for the common chassis rotation connection.

We claim:

1. A ride system for providing selective relative positioning of vehicles in an amusement or theme park ride such as to simulate racing, comprising:

a chassis adapted to be supported by and to travel along a length of track provided for a ride;

a support attached to the chassis to move with the chassis along the track;

first and second passenger vehicles spaced apart on and supported by the support;

wherein the first and second vehicles each include two or more seats in a body and wherein the two or more seats in the body face a like direction; and a drive assembly linked to the support to rotate the support about a rotation axis, wherein the first and second vehicles are moved concurrently by the drive assembly to alter their position relative to the track by rotating the body of each of the first and second vehicles about an axis extending through the support, parallel to the rotation axis of the support, to change an angular orientation of the body relative to a longitudinal axis of the support.

2. The ride system of claim 1, wherein at least a portion of the drive assembly is housed within the support and is driven by a drive mechanism positioned external to the support to move the first and second vehicles concurrently with rotation of the support.

3. The ride system of claim 2, wherein the portion of the drive assembly within the support comprises a gear train with a stationary drive gear and the support is linked to the drive mechanism such that the support rotates about the rotation axis, the gear train further comprises a pair of driven gears rotating about the drive gear in response to the rotation of the support, each of the driven gears being linked to one of the first and second vehicles, whereby the first and second vehicles rotate concurrently with each other and the support.

4. The ride system of claim 2, wherein the portion of the drive assembly within the support comprises a pulley assembly with a central, stationary drive pulley and the support is attached to the drive mechanism such that the support rotates with the drive pulley about the rotation axis, the pulley assembly including a pair of driven pulleys linked to the drive pulley to rotate about the stationary drive pulley and each of the pair of driven pulleys is linked to one of the first and second vehicles such that vehicles rotate concurrently with the driven pulleys and the support.

5. The ride system of claim 1, wherein the support has freedom of motion to rotate 360 degrees about the rotation axis and wherein the vehicles are arranged on the support to be positionable in an inline vehicle configuration with either of the first and second vehicles positioned as a lead vehicle and in a plurality of side-by-side configurations with either of the first and second vehicles positioned on a left side of the support.

6. The ride system of claim 1, wherein the support is an elongate arm and the first and second vehicles are positioned at opposite ends of the arm and wherein the rotation axis is a central axis of the arm.

7. The ride system of claim 1, wherein the rotation axis is transverse to the track and wherein the drive assembly operates to rotate the support to move the first and second vehicle from a first position in which the vehicles are in a common horizontal plane to a second position in which the vehicles are in two separate horizontal planes.

8. The ride system of claim 1, wherein the first and second vehicles are positioned on the support such that the rotation axis extends between the first and second vehicles and wherein the first and second vehicles are rotated about a pair of axes parallel to the rotation axis at least partially concurrently with each other and with the support.

9. The amusement park ride of claim 1, further comprising a controller operating the drive assembly to rotate the support in response to inputs from sensors sensing interaction of passengers in the vehicles.

10. The amusement park ride of claim 9, wherein the sensed passenger interaction comprises at least one of pedaling, acting, screaming, inputting answers to questions, and shooting targets.

11. A racing ride assembly for use in providing amusement park guests a racing experience, comprising:

a track defining a course for a ride;

a chassis configured to engage the track;

a drive mechanism supported by the chassis and including a drive member that is selectively rotatable;

a support arm positioned on the chassis and linked to the drive member, wherein the support arm rotates about its central axis in response to rotation of the drive member;

a pair of vehicle bodies, adapted for passenger seating, positioned near opposite ends of the support arm;

a drive assembly housed in the support arm and configured to rotate with the support arm and to concurrently rotate the vehicle bodies in response to rotation of the support arm, wherein the support arm is positioned in a plurality of positions relative to the track including a first position in which the support arm is substantially parallel to a direction of travel along the track and a second position in which the support arm is transverse to the direction of travel, whereby the vehicle bodies are inline relative to each other in the first position and are side-by-side relative to each other in the second position; and a control system selectively operating the drive mechanism to rotate the drive member to move the support arm among the plurality of positions, wherein the control system selectively operates the drive mechanism in response to sensed actions of one or more passengers in the vehicle bodies as the chassis travels over the ride track to rotate the support arm.

12. The amusement park ride of claim 11, wherein the sensed actions comprise at least one of pedaling, acting, screaming, inputting answers to questions, and shooting targets.

13. An amusement park ride comprising:

two or more vehicles with seats for passengers;

a track defining a course over which the vehicles travel in the amusement park ride;

a chassis riding on the track;

a vehicle support pivotably mounted to the chassis, wherein the vehicles are pivotably mounted upon the support; and a drive assembly operable to pivot the vehicle support and, concurrent with the pivoting of the vehicle support, to pivot one or more of the vehicles, wherein the vehicle support pivots about a central axis and the vehicles each pivot about an axis that extends through the support and that is substantially parallel to the central axis.

14. The amusement park ride of claim 13, further comprising a controller operating the drive assembly in response to inputs from sensors sensing interaction of passengers in the vehicles.

15. The amusement park ride of claim 14, wherein the sensed passenger interaction comprises at least one of pedaling, acting, screaming, inputting answers to questions, and shooting targets.

16. The amusement park ride of claim 13, wherein the vehicles are alternatively positionable in an inline positions and in a side-by-side position relative to each other.

17. The amusement park ride of claim 16, wherein the drive assembly is housed within the vehicle support and the ride further comprises a ride controller and a drive mechanism supported on the chassis and linked to the drive assembly to respond to control signals from the ride controller to selectively pivot the vehicle support and vehicles at one or more locations in the course.

18. The amusement park ride of claim 13, wherein the drive assembly includes a drive mechanism in the vehicle support operable to independently orientate each of the vehicles relative to the track, whereby each of the vehicles may be oriented in a like or a differing manner.

* * * * *